US006581355B1

(12) United States Patent
Yuyama et al.

(10) Patent No.: US 6,581,355 B1
(45) Date of Patent: Jun. 24, 2003

(54) TABLET FILLING DEVICE

(75) Inventors: Shoji Yuyama, Toyonaka (JP); Tsuyoshi Kodama, Yoyonaka (JP); Takashi Tamura, Toyonaka (JP)

(73) Assignee: Yuyama Mfg. Co., Ltd., Toyonaka (JP)

( * ) Notice: Subject to any disclaimer, the term of this patent is extended or adjusted under 35 U.S.C. 154(b) by 0 days.

(21) Appl. No.: 09/869,048

(22) PCT Filed: Oct. 30, 2000

(86) PCT No.: PCT/JP00/07610

§ 371 (c)(1),
(2), (4) Date: Jun. 22, 2001

(87) PCT Pub. No.: WO01/32508

PCT Pub. Date: May 10, 2001

(30) Foreign Application Priority Data

Nov. 1, 1999 (JP) ..... 11-311064

(51) Int. Cl.[7] ..... B65B 61/00; B65B 39/00; B65B 43/42; B65G 47/24

(52) U.S. Cl. ..... 53/135.1; 53/237; 53/250; 198/389; 141/168

(58) Field of Search ..... 53/135.1, 136.1, 53/201, 237, 249, 250, 415; 198/389, 468.9, 468.1; 141/168, 171, 172

(56) References Cited

U.S. PATENT DOCUMENTS 2,936,921 A * 5/1960 Schulz ..... 53/136.1
3,871,943 A * 3/1975 Zodrow ..... 53/136.1
4,325,418 A * 4/1982 Henle ..... 141/172
4,470,797 A * 9/1984 Harry et al. ..... 198/468.9
4,473,098 A * 9/1984 Sawvel ..... 141/172
5,454,209 A * 10/1995 Kikuchi ..... 53/415
5,882,596 A * 3/1999 Breeser et al. ..... 198/468.9
5,947,169 A * 9/1999 Wegman et al. ..... 141/2
6,000,446 A * 12/1999 Wegman et al. ..... 141/2
6,347,648 B1 * 2/2002 Wegman et al. ..... 141/2

FOREIGN PATENT DOCUMENTS

| | | |
|---|---|---|
| JP | 34-21586 | 12/1959 |
| JP | 4-16411 | 1/1992 |
| JP | 9-39929 | 2/1997 |
| JP | 11-70901 | 3/1999 |

* cited by examiner

*Primary Examiner*—Anthony D. Stashick
(74) *Attorney, Agent, or Firm*—Wenderoth, Lind & Ponack, L.L.P.

(57) ABSTRACT

In order to feed tablet vessels in with simple and low-cost construction, there is provided a vessel holder member (76) having fork-like support portions (78). The vessel holder member (76) is capable of linearly reciprocating between a vessel supporting position and a tablet receiving position. At the vessel supporting position, the vessel holder member (76) receives a tablet vessel (11) fed from a vessel feed section 3 and a flange of the tablet vessel (11) is supported by the support portions (78). At a tablet receiving position, the tablets fed from the tablet feed section (2) are contained in the tablet vessel (11).

14 Claims, 27 Drawing Sheets

TABLET FILLING DEVICE

TECHNICAL FIELD

The present invention relates to a tablet packing apparatus and more particularly to a tablet packing apparatus characterized in tablet-vessel feed configuration.

BACKGROUND OF THE INVENTION

Conventionally, there has been known a tablet packing apparatus in which the direction of a tablet vessel fed from a tablet vessel feed section is detected to turn the opening thereof upward and is held on a holding portion of the outer periphery of a rotatable disc to fill the tablet vessel with tablets (refer to Japanese Laid-open patent publication No. HEI11-70901).

However, in the tablet packing apparatus, for detecting the direction of the opening of the tablet vessel, changing the direction and holding the tablet vessel with the disc, separate independent mechanisms are required. Therefore, there are disadvantages that the construction is complicated and the cost is increased.

SUMMARY OF THE INVENTION

It is an object of the present invention to provide a tablet packing apparatus which is possible to feed tablet vessels in a simple and low-cost construction.

The present invention provides, as a means to solve the above-described problems, a tablet packing apparatus in which tablets fed from a tablet feed section are contained into a tablet vessel fed from a tablet vessel feed section. The apparatus comprises a vessel holder member having fork-like support portions. The vessel holder member is capable of linearly reciprocating between a vessel supporting position where the vessel holder member receives and supports the tablet vessel fed from the tablet vessel feed section and a tablet receiving position where the tablets fed from the tablet feed section are contained in the tablet vessel, whereby a flange of the tablet vessel fed from the tablet vessel feed section is supported by the support portion.

According to the above construction, even if the tablet vessel is fed from the tablet vessel feed section in any directions of opening side and bottom side, the flange of the tablet vessel is necessarily supported by the support portion, and thereby the tablet vessel is positioned with the opening directed upward.

It is preferable, in a point of effective use of the dead space generated by providing the support portions, that the tablet packing apparatus further comprises a label fitting portion for fitting a label on the outer surface of the tablet vessel fed from the tablet vessel feed section as the tablet vessel is guided and rotated.

It is preferable, in a point of being possible to treat various tablet vessels with a slight improvement, that the support portions are formed so that the distances between the support portions are different according to difference of sizes of the tablet vessels.

It is preferable that the tablet packing apparatus further comprises a lifting member for lifting the tablet vessel supported on the support portions and a tablet packing member for temporarily accumulating the tablets fed from the tablet feed section and packing the tablets into the tablet vessel lifted by the lifting member.

In the tablet packing apparatus according to the present invention, a construction that the flange of the tablet vessel is supported by the support portion allows the structure to be simplified and produced cheaply.

Since the label fitting portion for fitting the label on the outer surface of the tablet vessel as the tablet vessel is guided and rotated is provided, such an additional function can be obtained by effective use of the dead space and compact construction.

As the support portions are formed so that the distances between the support portions are different according to difference of sizes of the tablet vessels, it is possible to treat various tablet vessels with a slight improvement, an easy design and a low cost.

As the tablets fed from the tablet feed section are accumulated in the tablet packing member and packed into the tablet vessel lifted by the lifting member, it is possible to pack the tablets with a simplified construction and with a small space to be possessed.

BRIEF DESCRIPTION OF THE DRAWINGS

FIG. 2(*b*) is a fragmentary perspective view of the vessel holder shown in FIG. 2(*a*);

FIG. 5(*b*) is a bottom view illustrating the feeder vessel shown in FIG. 5(*a*);

FIG. 6(*b*) is a fragmentary view illustrating a dividing fin in FIG. 6(*a*);

FIG. 7(*b*) is a bottom view illustrating the rotor shown in FIG. 7(*a*);

DETAILED DESCRIPTION OF THE PREFERRED EMBODIMENTS

Hereinafter, the preferred embodiment of the present invention will be explained with reference to the accompanying drawings.

Figure 1:
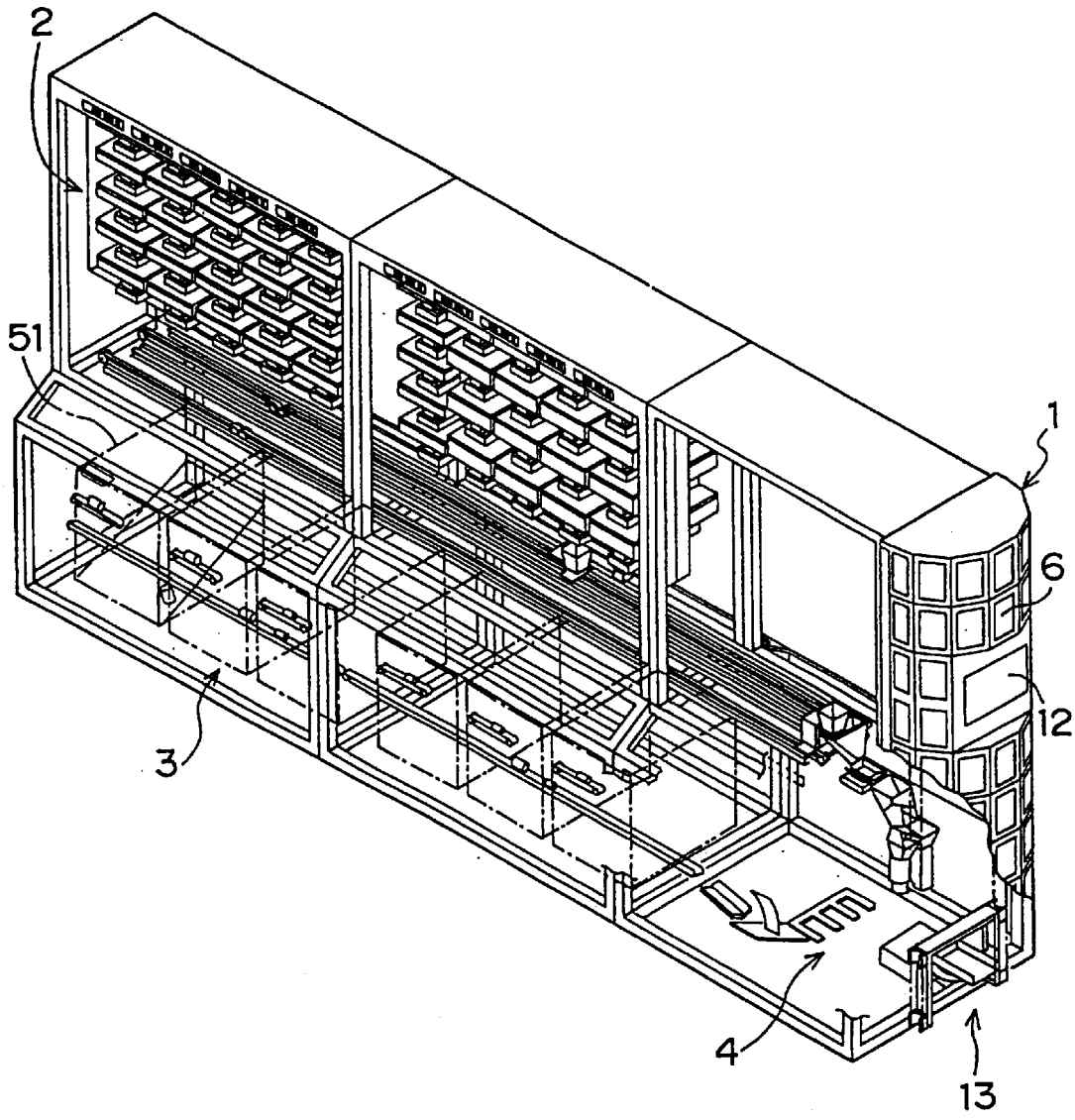
FIG. 1 is a perspective overall view illustrating a tablet packing apparatus in accordance with the invention;.

FIG. 1 shows a tablet packing apparatus in accordance with the invention. The apparatus generally comprises storage shelves 1 provided on one end side of the apparatus, a tablet feeding section 2 provided in the upper part of the apparatus, tablet vessel feeding sections 3 provided under the tablet feeding section 2, a tablet packing section 4 provided between the storage shelves 1 and the tablet vessel feeding sections 3, and a controlling section 5 (see FIG. 17).

Figure 2A:
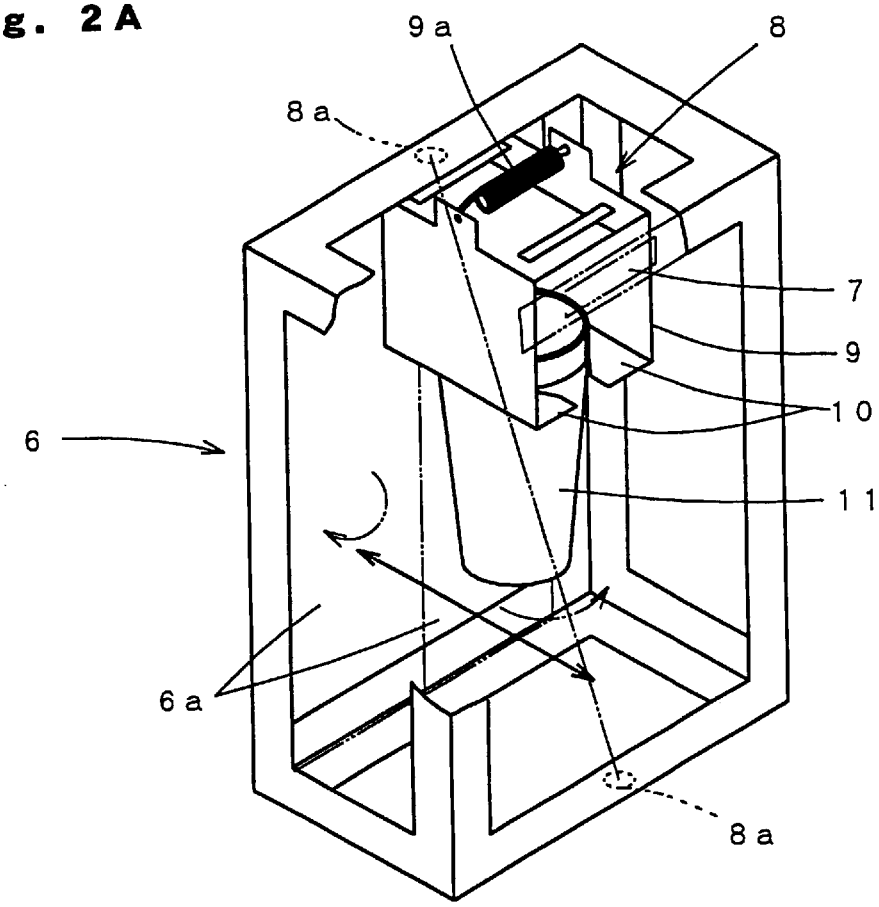
FIG. 2(*a*) is a perspective view illustrating a container chamber in storage shelves shown in FIG. 1.
Figure 2B:
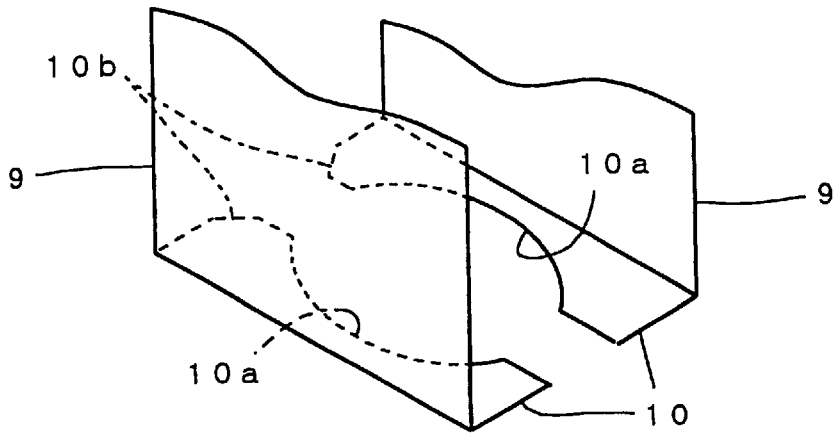

The storage shelves 1 have a generally semi-cylindrical shape and include a plurality of container chambers 6. As shown in FIG. 2(*a*), each container chamber 6 has a rectangular frame body in which at least the surfaces opposed in the direction shown by an arrow in FIG. 2(*a*) have openings. The openings are closed with doors 6*a* biased by means of unshown springs or so. The doors 6*a* can be opened toward the front surface side, preventing one's hand from being inserted into a packed vessel conveyor 13 that will be explained hereinafter. The doors 6*a* can be pivoted within a range that does not interfere with a tablet vessel 11 held by a vessel holder 8 that will be explained hereinafter. A display 7 is provided on the upper part of the front side of the container chamber 6. In the embodiment, the feeder vessel number and the tablet count number are displayed on the display 7. The container chamber 6 is also provided with a vessel holder 8. In the vessel holder 8, a pair of holding plates 9 are opposed to each other in a horizontal direction. The holding plates 9 are biased by a spring 9*a* in the direction in which the holding plates 9 come close to each other. At the lower ends of the holding plates 9 are formed holding lugs 10 which extend in the direction in which the holding plates 9 are opposed. As shown in FIG. 2(*b*), on opposed edges of the holding lugs 10 are formed recesses 10*a* which have a generally elliptic shape so as to hold a tablet vessel 11. At the back side corners of the holding lugs 10 are formed cutouts 10*b* which are spread out toward the inside. The cutouts 10*b* are provided to facilitate the insertion of the tablet vessel 11 into the recesses 10*a*. A vessel sensor 8*a* is capable of detecting whether the tablet vessel 11 is held by the vessel holder 8 in the container chamber 6 or not.

As shown in FIG. 1, a touch panel 12 is provided in the center part of the outer circumference of the storage shelves 1, instead of the container chamber 6. The touch panel 12 is provided to allow instruction data on the prescription to be input directly.

Figure 3:
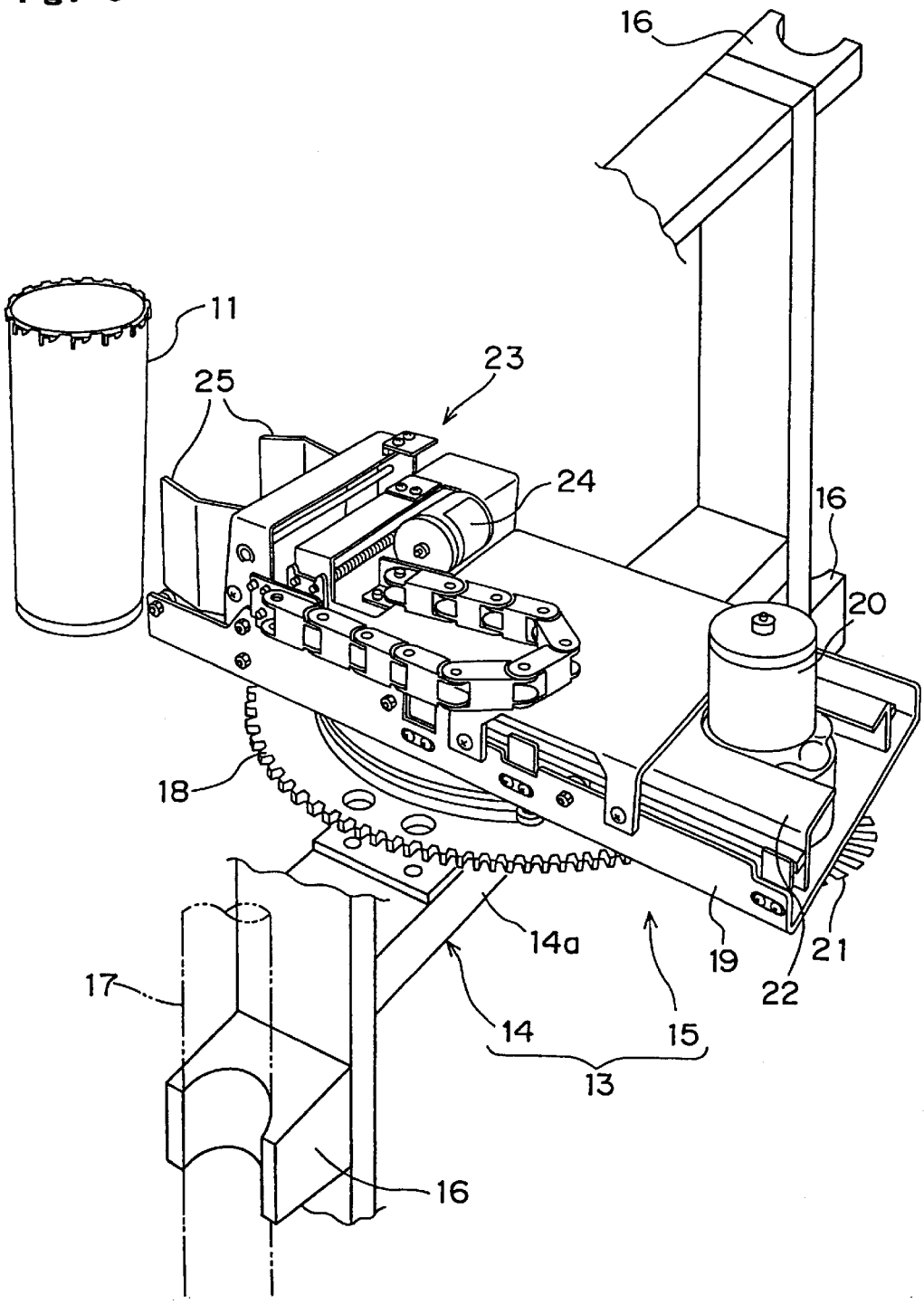
FIG. 3 is a perspective view illustrating an arm member in FIG. 1.

Inside the storage shelves 1 is provided a conveyor 13 for packed vessel. In the conveyor 13, as shown in FIG. 3, an arm member 15 is pivotally mounted to a rectangular frame 14 which is capable of traveling vertically.

A bearing recess 16 is provided at each of the upper and lower ends of both outside surfaces of the rectangular frame 14. The bearing recesses 16 are in sliding contact with guide shafts 17 standing at a given interval behind the storage shelves 1. The conveyor 13 can be moved vertically through the medium of a belt (not shown) by the driving of a motor (not shown). A first driving gear 18 is fixed to the center of the lower horizontal plate 14*a* of the rectangular frame 14. Instead of the bearing recess 16, a roller or a bearing that comes into slide contact with the guide shaft 17 can be used.

The arm member 15 comprises an arm body 19 mounted rotatably on the center shaft of the first driving gear 18. A first driving motor 20 is provided on one end portion of the arm body 19. To the rotating shaft of the first driving motor 20 which protrudes from the bottom surface of the arm body 19 are fixed position detection plates 21 and a second driving gear (not shown) engaged with the first driving gear 18. A rotational position of the second driving gear can be determined by the detection of the position detection plates 21 by a sensor (not shown). With this arrangement, the arm member 15 is rotated in forward or reverse direction in a range of 180° by the drive of the first driving motor 20. On the top surface of the arm body 19 is provided a sliding member 22 which is driven by a built-in, second driving motor. (not shown) and thereby reciprocates in the longitudinal direction. On one end portion of the sliding member 22 (on the side opposite to the first driving motor 20) is provided a gripping member 23. The gripping member 23 comprises a pair of gripping pieces 25 which are driven through a gear not shown by a third driving motor 24 provided on the sliding member 22 and thereby opened and closed. The third driving motor 24 is driven and stopped based on an electric current value that fluctuates due to a difference of load applied on the gripping pieces 25. Specifically, when the load of the third driving motor 24 increases at the time of gripping and releasing the tablet vessel 11 and then the electric current value exceeds a threshold value (obtained by adding a margin electric current to an electric current value at the normal operation), the third driving motor 24 is stopped. The increase of the load at the time of releasing the tablet vessel 11 is caused by allowing the gripping pieces 25, to come into contact with a stopper (not shown) at a predetermined open position. The gripping pieces 25 are urged toward the open position by an unshown spring or so in order to absorb the backlash of the gear.

The tablet feeding section 2 comprises a tablet container section 26 and a tablet conveyor section 27.

Figure 4:
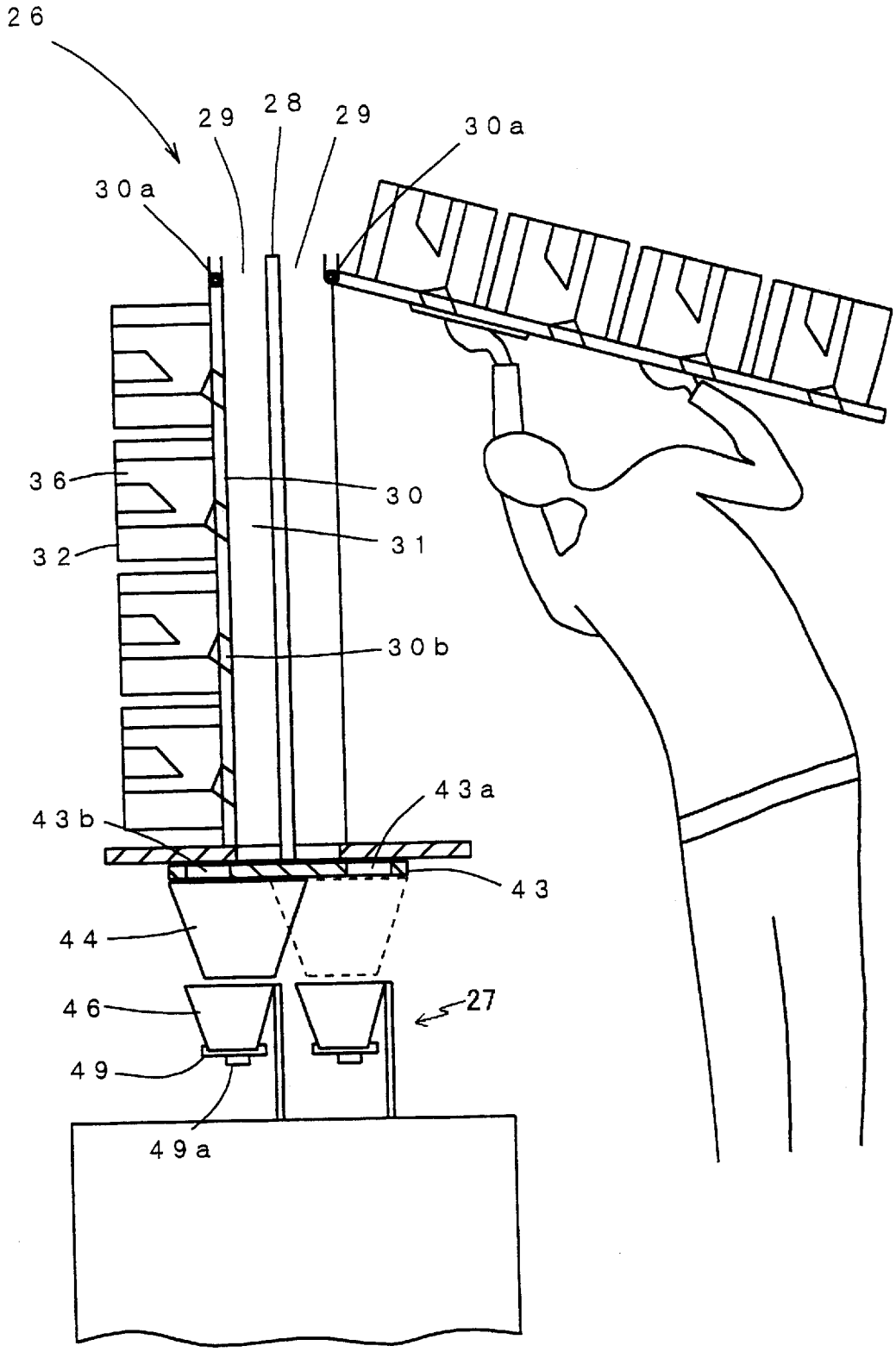
FIG. 4 is a sectional view illustrating a tablet container section in shown FIG. 1.

In the tablet container section 26, as partly shown in FIG. 4, grooves 29 extending vertically are provided on both sides of a vertical wall 28. Each groove 29 is covered with a shelf member 30 provided pivotably about a pivot 30*a* so that common guide paths 31 are formed. A plurality of openings 30*b* for discharging tablets are provided in a vertical line on each shelf member 30. A plurality of motor bases 32 corresponding to the openings 30*b* for discharging tablets are mounted to the outer surface of each shelf member 30.

Figure 5A:
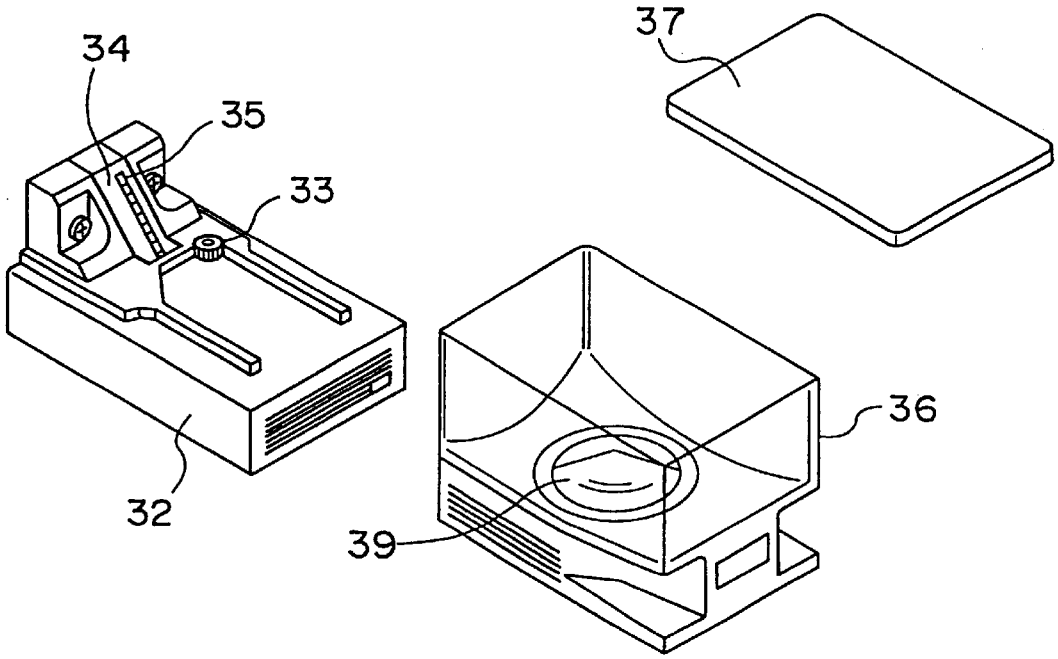
FIG. 5(*a*) is an exploded perspective view illustrating a motor base and a feeder vessel shown in FIG. 4.
Figure 5B:
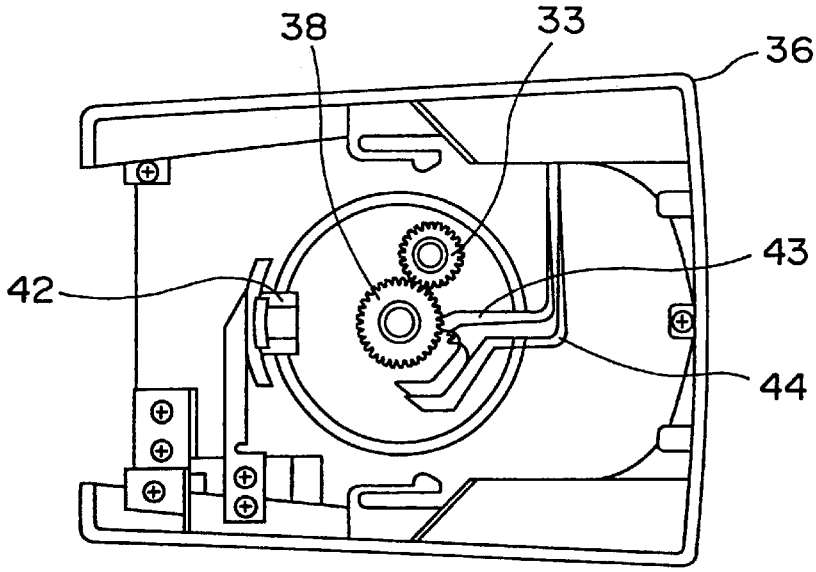
Figure 6A:
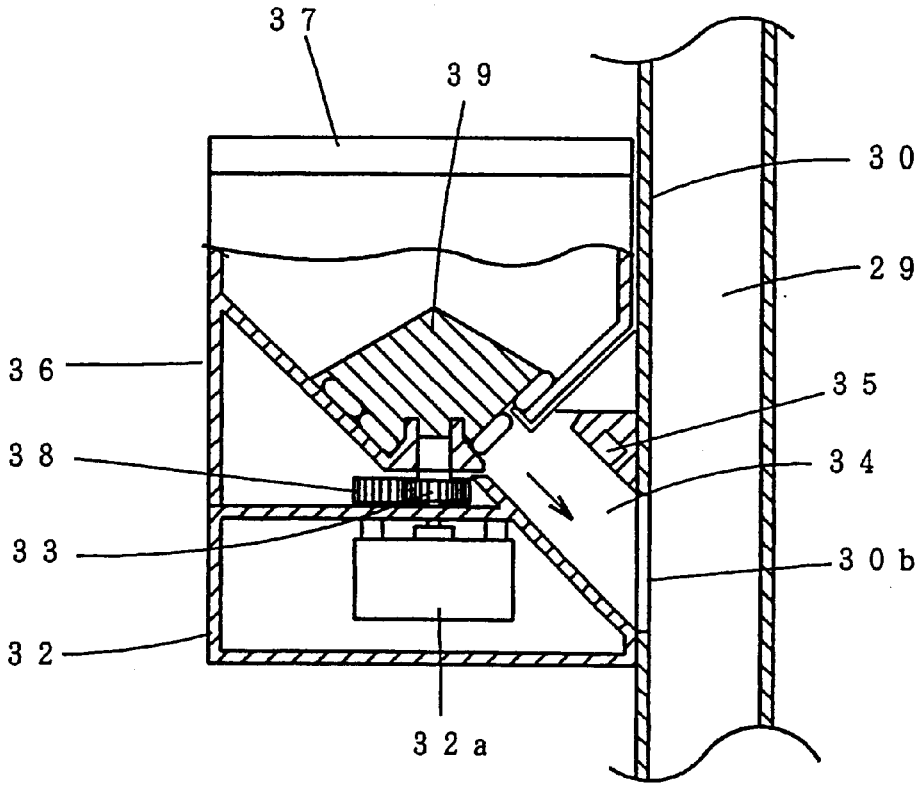
FIG. 6(*a*) is a sectional view illustrating the motor base and the feeder vessel in FIG. 4.

As shown in FIG. 6A, each motor base 32 has a built-in driving motor 32*a*. A driving gear 33 to which the power from the driving motor 32*a* is transferred is exposed on the top surface of the motor base 32 (see FIGS. 5A, 5B). A fall guide path 34 is formed on one end side of the motor base 32. A tablet detecting sensor 35 is provided on the inner wall of the fall guide path 34, so that the tablets discharged through the fall guide path 34 can be detected (counted).

A feeder vessel 36 is detachably mounted to the motor base 32. The feeder vessel 36 is generally in the shape of a rectangle which opens upward and which can be covered with a cover 37. In the feeder vessel 36 is stored tablets. At the bottom of the feeder vessel 36 is provided a rotor 39 having a gear 38 at the lower end thereof.

Figure 6B:
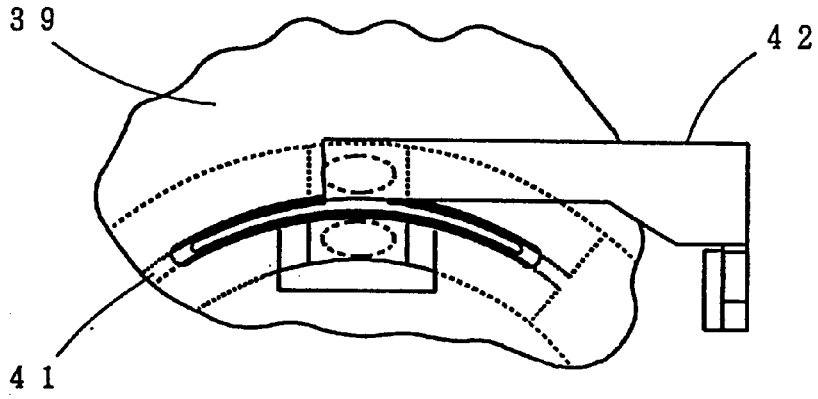
Figure 7A:
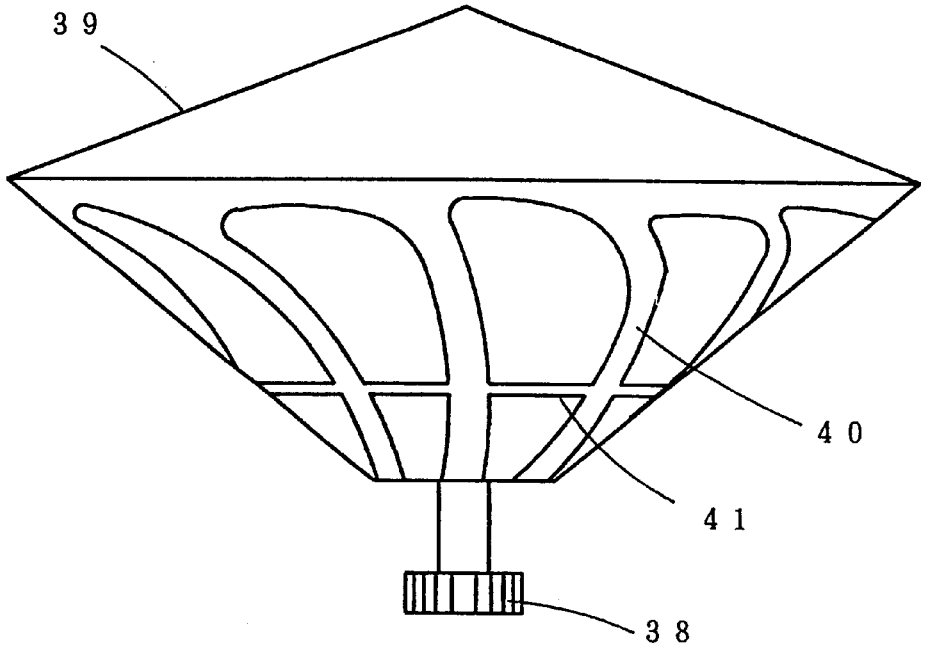
FIG. 7(*a*) is a front view illustrating a rotor provided in the feeder vessel shown in FIG. 4.
Figure 7B:
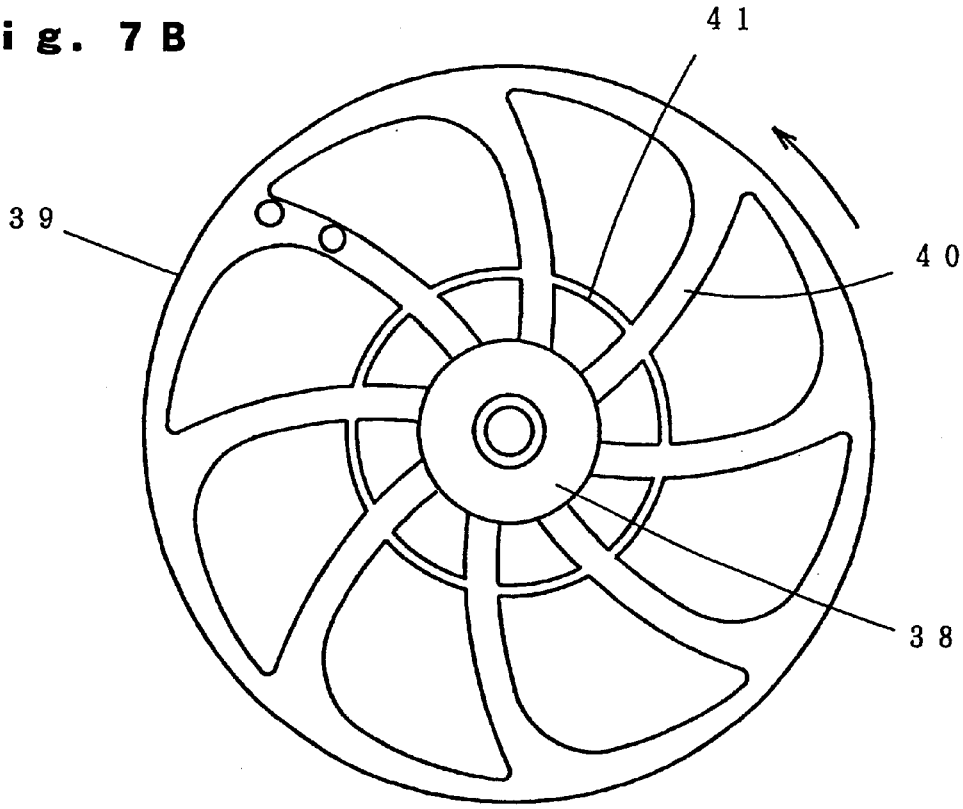

As shown in FIG. 7, the rotor 39 has conical surfaces on its upper and lower parts. The attachment of the feeder vessel 36 to the motor base 32 engages the gear 38 with the gear 33 on the motor base 32. On the lower conical surface of the rotor 39 are formed tablet guiding grooves 40 that extend spirally toward the center of the surface, and dividing grooves 41 dividing each tablet guiding groove 40 into two parts are formed in the middle thereof. The spiral direction of the tablet guiding grooves 40 toward the center of rotation of the rotor 39 is opposite to the direction of rotation of the rotor 39 (opposite to the direction shown in the arrow in FIG. 7(*b*)). A dividing fin 42 is provided in the dividing grooves 41. With the rotation of the rotor 39, as shown in FIG. 6(*b*), the dividing fin 42 divides the line of tablets that pass through the tablet guiding grooves 40.

As shown in FIG. 5(*b*), a gear stopper 43 is capable of engaging with the gear 38 in the feeder vessel 36 when the feeder vessel 36 is detached from the motor base 32 and disengaged from the gear 38 when the feeder vessel 36 is mounted. The gear stopper 43 is biased against the gear 38 by a stopper spring 44. Even though the feeder vessel 36 is detached from the motor base 32, the above arrangement allows the gear stopper 43 to engage with the gear 38 and prevents the rotor 39 from rotating, so that tablets cannot fall out of the feeder vessel 36.

In the tablet feeding section 2, when the driving motor 32*a* in the motor base 32 is driven with the feeder vessel 36 attached to the motor base 32, the rotor 39 is rotated through the medium of the gear 33 and of the driving gear 38, and thereby tablets move in a line toward the center of rotation, forming a line for each tablet guiding groove 40. As mentioned above, the tablet guiding grooves 40 are formed so as to extend spirally toward the center of rotation of the rotor 39 in the direction opposite to the direction of rotation of the rotor 39. Tablets are therefore forced to move toward the center of rotation regardless of the centrifugal forces exerted on the tablets by the rotation of the rotor 39. The line of tablets is divided by the dividing fin 42 before each tablet guiding grooves 40 communicates with the fall guide path 34, and then fall one by one into the common guide path 31 through the fall guide path 34.

At the lower ends of the common guide paths 31 are provided a shutter 43 for temporarily retaining the tablets which have fallen from the fall guide path 34. The shutter 43 comprises a single plate which can horizontally slide across the common guide paths 31. At the both end portions of the shutter 43, openings 43*a*, 43*b* are formed. When the shutter 43 slides toward the left side, the right common guide path 31 is opened by the right opening 43*a*. When the shutter 43 slides toward the right side, the left common guide path 31 is opened by the left opening 43*b*. When the shutter stops at the middle point of the slide stroke, both of the common guide paths 31 are closed.

Beneath the shutter 43, a hopper 44 is slidably and detachably disposed. Along with the slide operation of the shutter 43, the hopper 44 can slide to a position where the hopper 44 can receive the tablets. Thus, the tablets received through the common guide paths 31 can be fed to respective conveyor vessels 46 in the tablet conveyor section 27 disposed beneath the hopper 44.

Figure 15A:
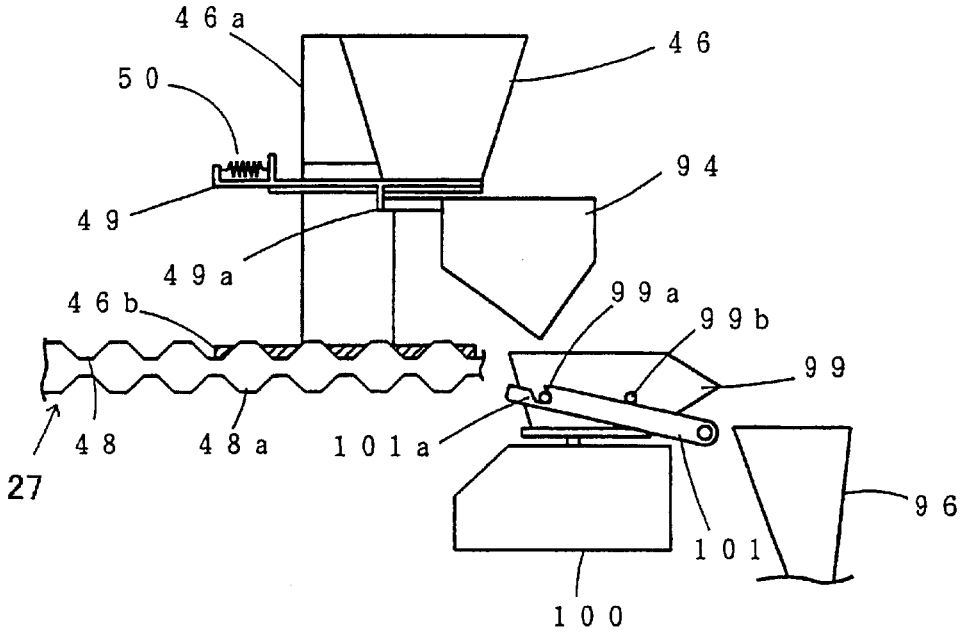
FIGS. 15(*a*) and 15(*b*) are front views illustrating the operation of a tablet weighing section of the tablet packing section shown in FIG. 11.
Figure 15B:
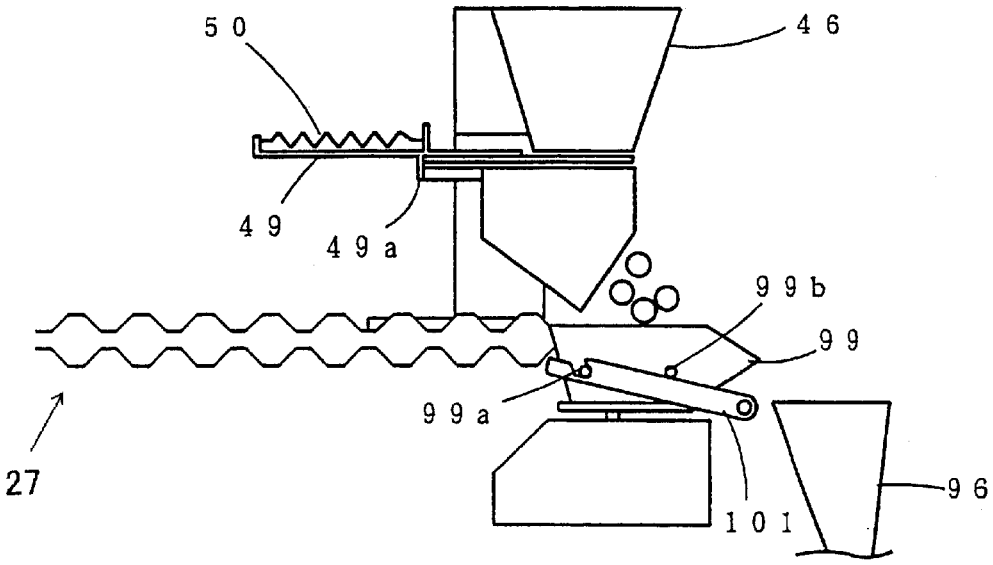

The tablet conveyor section 27 comprises two lines of conveyor belts 48 and conveyor vessels 46. The conveyor belts 48 are looped between a pair of pulleys 47. The conveyor vessels 46 are supported on the conveyor belts 48 by a support frame 46*a* so as to be reciprocated. Rectangular apertures 46*c* are provided in a line on a bottom plate 46*b* of the support frame 46*a* (see FIGS. 11 and 15A). The conveyor belt 48 has continual guide projections 48*a*, which engage with the rectangular apertures 46*c* to allow the conveyor vessel 46 to be moved. The bottom of the conveyor vessel 46 comprises a shutter 49 which can be opened and closed. The shutter 49 is biased, as shown in FIGS. 15A and 15B, by a spring 50 provided at one end of the shutter 49 so as to shut the bottom of the conveyor vessel 46. A protrusion 49*a* is formed at one end on the downside surface of the shutter 49.

Figure 8:
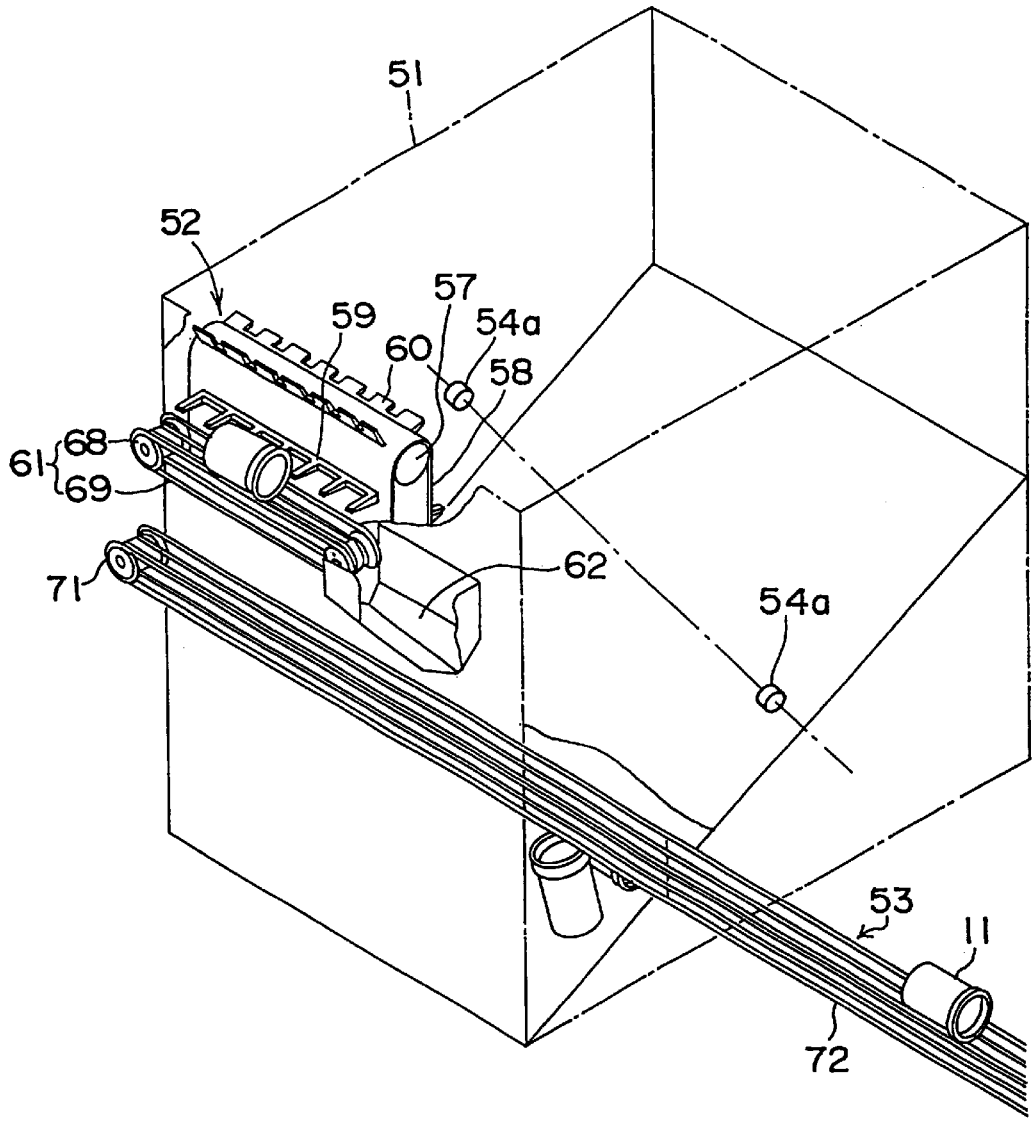
FIG. 8 is a perspective view illustrating a stock container shown in FIG. 1.
Figure 9:
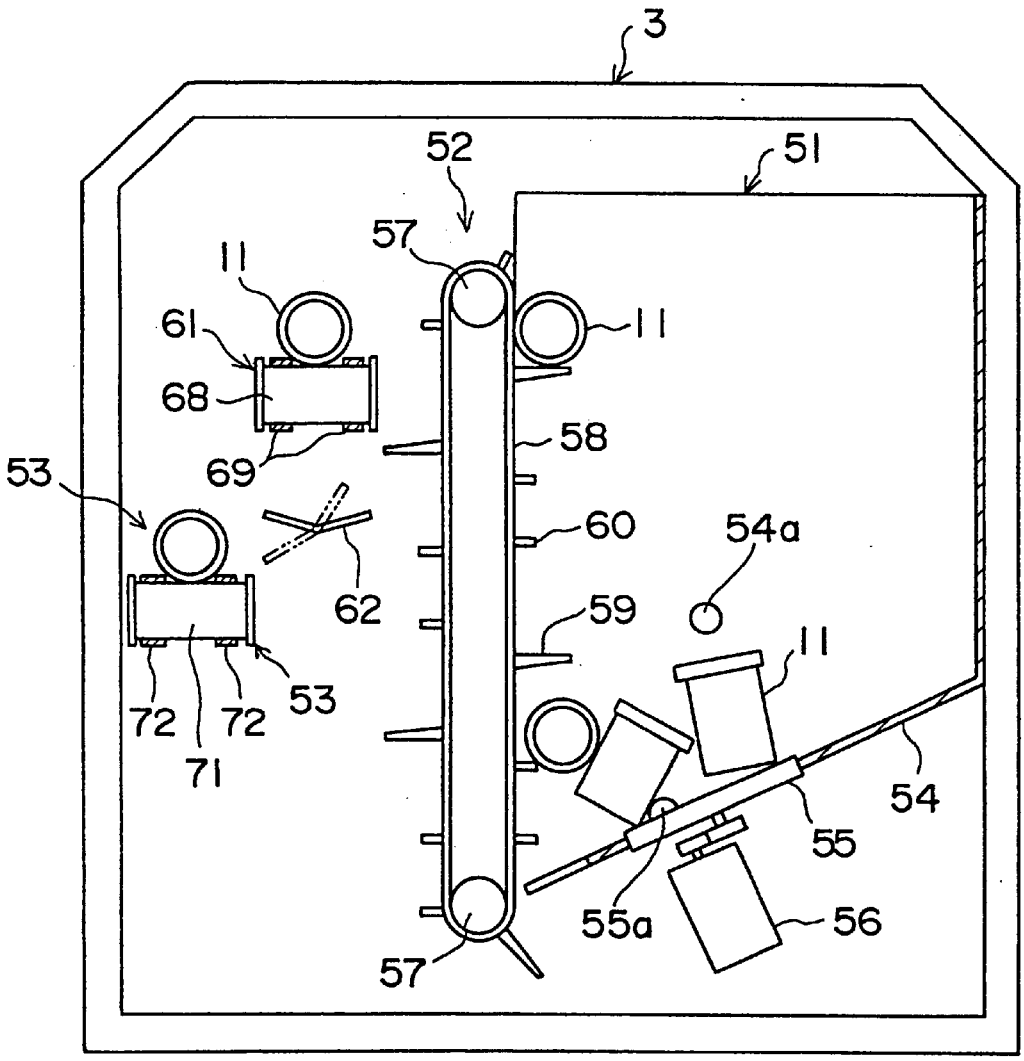
FIG. 9 is a sectional view of the stock container shown in FIG. 8.

As shown in FIGS. 8 and 9, each tablet vessel feeding section 3 comprises a stock container 51 for storing empty tablet vessels 11, a vessel takeout section 52 for taking out tablet vessels 11 one by one from the stock container 51, and an empty vessel conveyor 53 for conveying the tablet vessel 11 taken out from the stock container 51 by the vessel takeout section 52. The tablet vessel feeding sections 3 are disposed in a line as shown in FIG. 1. The sizes (outside diameters or lengths) of empty tablet vessels 11 stored in the stock containers 51 are different for each stock container 51.

The bottom wall 54 of the stock container 51 is inclined downwardly toward the vessel takeout section 52 and is provided with a rotation plate 55 in the vicinity of the vessel takeout section 52. The rotation plate 55 slightly protrudes from the bottom wall 54. The rotation plate 55 is periodically rotated both forward and backward by a motor 56 so that the inclined direction of the tablet vessels 11 with respect to the vessel takeout section 52 can be changed. On the upper surface of the rotation plate 55, a semi-spherical protrusion 55*a* is formed. The protrusion 55*a* allows the tablet vessel 11 to change its position lateral and assists in taking out of the tablet vessel 11 by the vessel takeout section 52. Transmission types of photo sensors 54*a* are provided above the inclined bottom wall 54. Indication lamps (not shown) provided on the stock container 51 indicate the remaining quantity of the tablet vessels 11 based on the detected signal of the photo sensors 54*a*. Namely, "F" lamp is ON when light between the photo sensors 54*a* is intercepted, while "L" lamp is ON when light between the photo sensors 54*a* is not intercepted. Moreover, "E" lamp is ON when a sensor provided on a delivery table 62 which will be described hereinafter does not detect the tablet vessel 11 for a predetermined time. Alternatively, the remaining quantity of the tablet vessels 11 may be indicated on the touch panel 12 as shown in FIG. 1.

Figure 10:
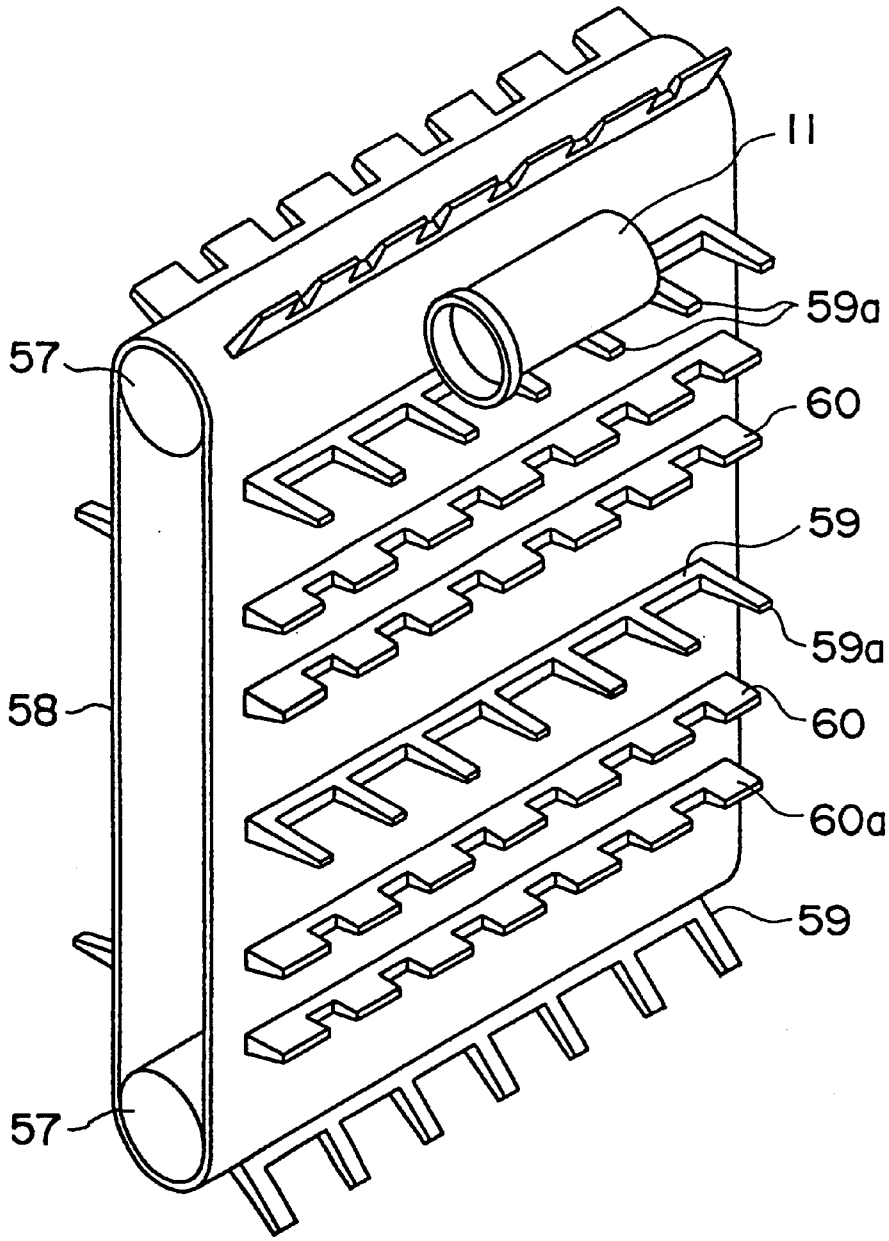
FIG. 10 is a perspective view illustrating a vessel taking out portion shown in FIG. 8.

The vessel takeout section 52, as shown in FIG. 10, comprises rollers 57 juxtaposed vertically and a belt 58 running between the rollers 57. On the belt 58, lateral vessel holding portions 59 are provided at a predetermined distance along the running direction. Between the lateral vessel holding portions 59, two vertical vessel eliminating portions 60 are provided. Each lateral vessel holding portion 59 comprises a plurality of holding fingers 59*a* protruding with a predetermined distance. Each vertical vessel eliminating portion 60 comprises a plurality of projections 60*a* protruding with a predetermined distance. The distance between the lateral vessel holding portions 59 is smaller than the height of the tablet vessel 11 and larger than the outside diameter of the tablet vessel 11. The distance between the holding fingers 59*a* is larger than the outside diameter of the tablet vessel 11. Thus, the lateral vessel holding portions 59 can surely hold the tablet vessel 11 laterally without engaging the open edge of the tablet vessel 11 with the holding fingers 59*a*.

The vessel takeout section 52, as shown in FIG. 8, further comprises a conveyor 61 and a delivery table 62 for conveying the tablet vessels 11 taken out by the vessel takeout section 52 to the empty vessel conveyor 53. The conveyor 61 comprises a pair of rollers 68 and four conveyor ropes 69 running between the rollers 68. The roller 68 is driven to rotate both forward and backward by a motor not shown. The distance between the conveyor ropes 69 is smaller than the outside diameter of the tablet vessel 11. The delivery table 62 has a substantially L shaped section and is pivotable between positions as shown in solid line and two dots chain line respectively in FIG. 9 to deliver the tablet vessels 11 conveyed by the conveyor 61 to the empty vessel conveyor 53. The vessel takeout section 52 is operated when no tablet vessel 11 is detected on the conveyor 61 by a sensor (not shown) for a predetermined time. The empty vessel conveyor 53 is operated in a reverse conveying direction for a predetermined time at the time of power ON initially and after emergency stop. If the empty tablet vessel 11 is present on the way of the empty vessel conveyor 53, the empty tablet vessel 11 is recovered into a recovery box not shown.

The empty vessel conveyor 53 is provided below the delivery table 62 along the stock containers 51 arranged in line. In the same manner as the conveyor 66, the empty vessel conveyor 53 comprises a pair of pulleys 71 and a pair of conveyor ropes 72 looped between the pair of pulleys 71.

Figure 11:
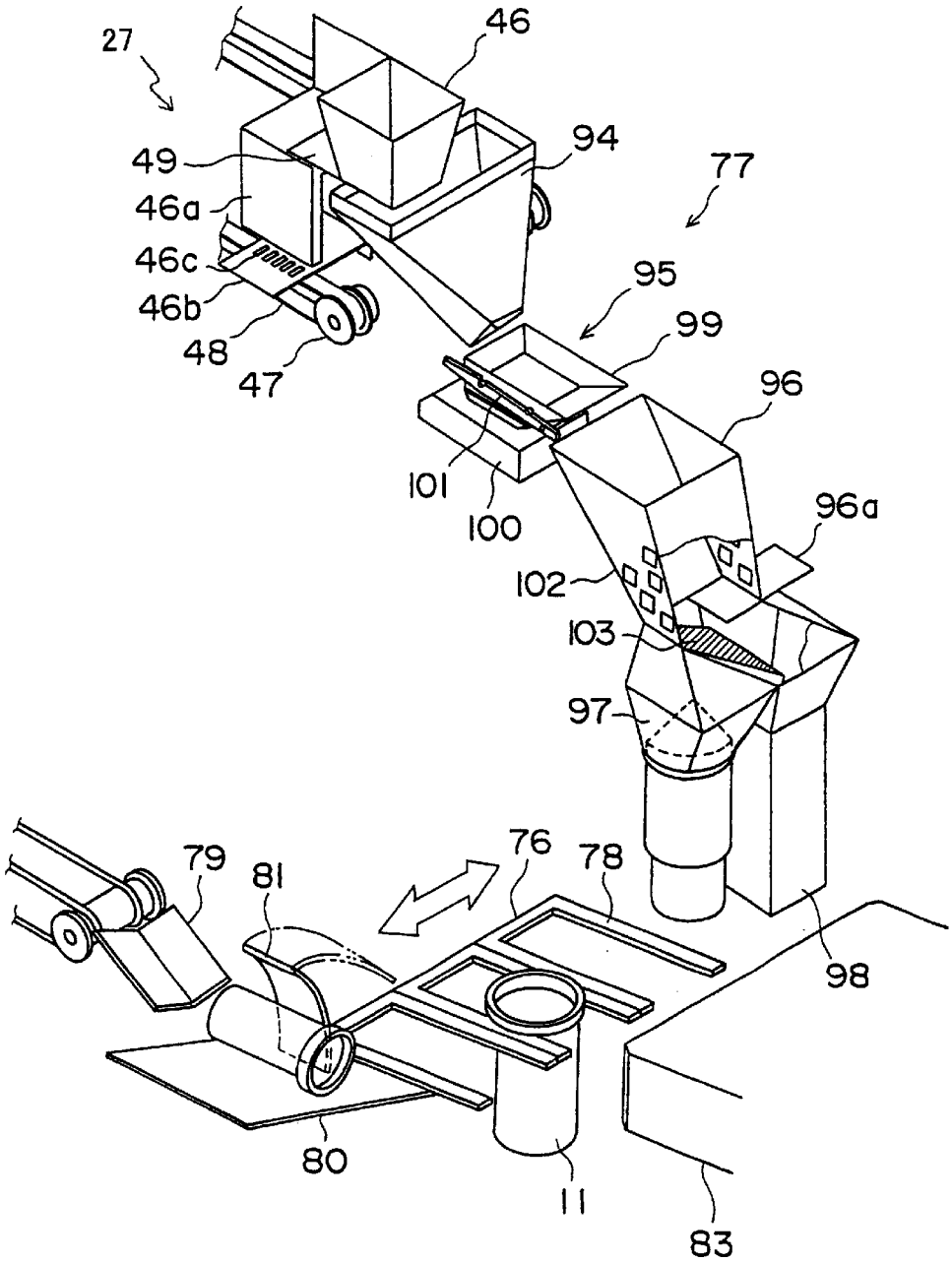
FIG. 11 is a fragmentary perspective view illustrating the vicinity of a tablet packing section in FIG. 1.

As shown in FIG. 11, the tablet packing section 4 comprises a fork-like vessel holder section 76 and a tablet weighing section 77.

Figure 12:
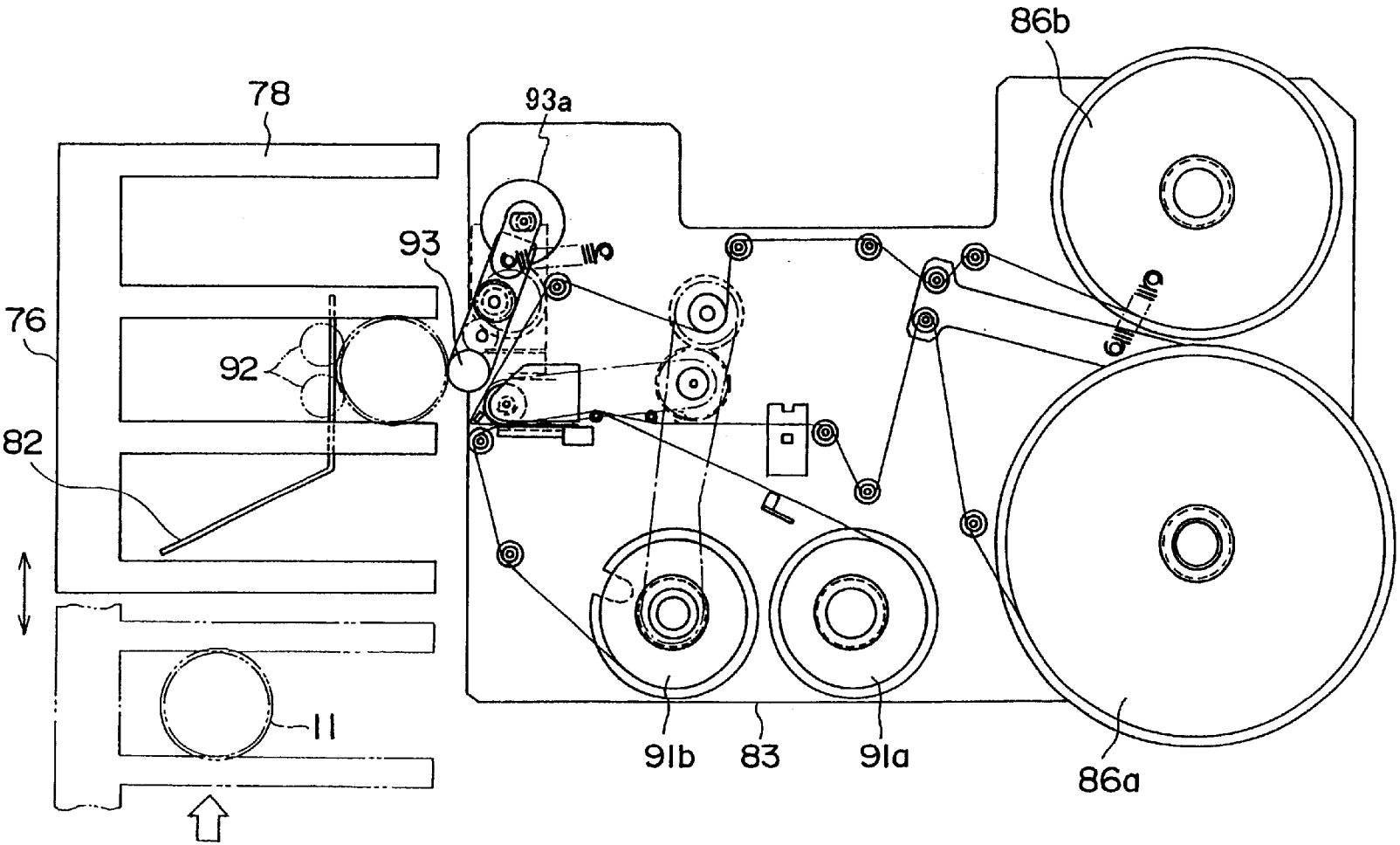
FIG. 12 is a plan view illustrating a vessel support portion and a label fitting apparatus in FIG. 11.
Figure 13:
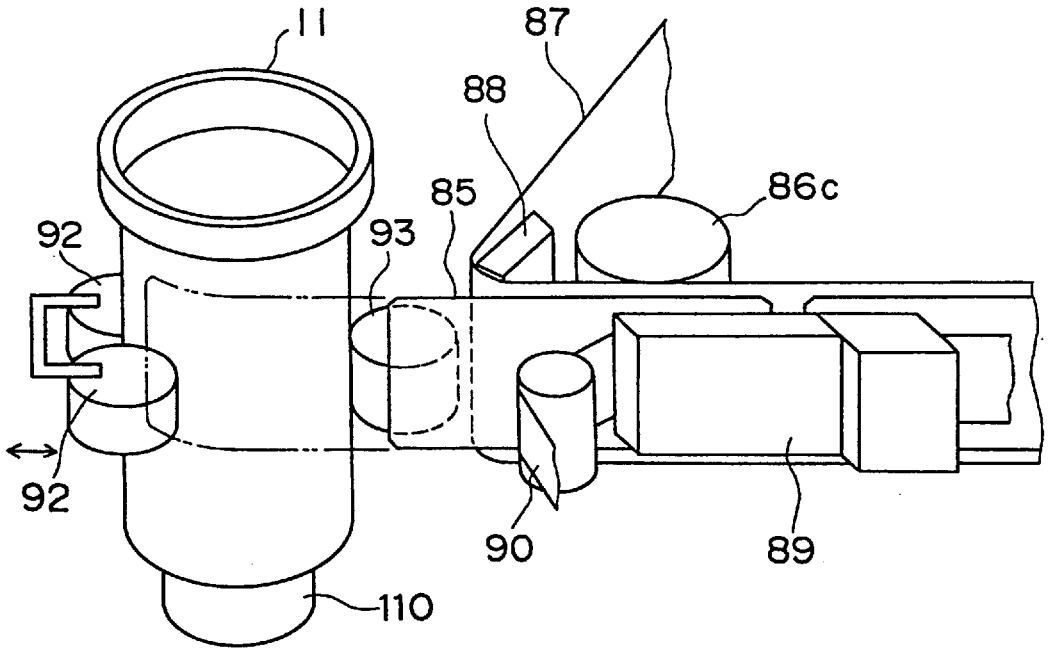
FIG. 13 is a partial enlarged perspective view of the label fitting apparatus shown in FIG. 12.

The vessel holder section 76 has a plurality of generally parallel support pieces 78 between which the tablet vessel 11 can be supported. The distance between the support pieces 78 corresponds to the size of the tablet vessels 11. As shown in FIGS. 11 and 12, the support pieces (78) are longer than the diameter of the tablet vessels (11). In the present embodiment, the vessel holder section 76 can hold S, M and L sizes of the tablet vessels 11. The vessel holder section 76 can reciprocate between a vessel receiving position and a tablet receiving position by means of drive unit (not shown).

In the vicinity of the vessel receiving position, first, second and third guide plates 79, 80 and 81 are disposed. The first guide plate 79 has a substantially V-shape so that the tablet vessel 11 conveyed by the empty vessel conveyor 53 can be delivered to the second guide plate 80. The second guide plate 80 is inclined so that the tablet vessel can roll on the second guide plate 80 toward the vessel holder section 76. The third guide plate 81 can pivot above the second guide plate 80 for allowing or disallowing the tablet vessel 11 to be passed to the vessel holder section 76. The third guide plate 81 may be provided with a delivery guide plate which allows the tablet vessel 11 to surely roll.

Under the vessel holder section 76, a vessel aligning plate 82 is disposed. The vessel aligning plate 82 allows the tablet vessels 11 held by the support pieces 78 to align when the vessel holder section 76 is horizontally moved. Thus, it is possible to reduce the necessary push quantity provided by push rollers 92 which will be described hereinafter, resulting in effective operation.

In the vicinity of the tablet receiving position, there are provided a labeler 83 and a lifter 84.

The labeler 83 is arranged to print a medicine name or so on labels 85 and fix the labels 85 to the tablet vessels 11. The labels 85 are in advance stuck to a sheet 87 wound on one roller 86*a* and released from the sheet 87 when the sheet 87 is turned at a guide tip 88. The sheet 87, from which the labels 85 have been released, is rewound on the other roller 86*b*. Printing on the labels 85 is carried out before releasing the labels 85 from the sheet 87 in such a manner that printing information is heat transferred through a ribbon 90 by means of printing head 89 as the sheet 87 is supported with a backing roller 86*c*. The ribbon 90 is fed from one roller 91*a* and rewound on the other roller 91*b*.

Under the vessel holder section 76, a pair of push rollers 92 and a guide roller 93 are disposed. A size detecting sensor (not shown) for detecting the size of the tablet vessels 11 is provided between the push rollers 92. The push rollers 92 are arranged to push the tablet vessel 11 aligned by the vessel aligning plate 82 in a protruding direction of the support pieces 78, thereby holding the tablet vessel 11 together with the guide roller 93 positioned on the other side. Beneath the tablet vessel 11 held by the push rollers 92 and the guide roller 93, a rotation bearing table 110 is disposed. The rotation bearing table 110 can be raised up to a height corresponding to the size of the tablet vessel 11 detected by the size detecting sensor. The guide roller 93 is urged toward the push roller 92 and rotates the tablet vessel 11 due to drive of a motor 93*a*.

The lifter 84 can lift up the tablet vessel 11 up to a rotation position where a flange portion of the tablet vessel 11 is positioned slightly above the support pieces 78 and a tablet receiving position where the tablet vessel 11 will receive the tablets from a packing hopper 97 which will be described hereinafter.

The tablet weighing section 77 comprises an input hopper 94, a weighing section 95, a measuring hopper 96, a packing hopper 97, and a discharging hopper 98.

As shown in FIG. 15, the approach of the conveyor vessel 46 to the input hopper 94 brings the protrusion 49*a* of the shutter 49 into contact with an edge of the input hopper 94, causing the shutter 49 to open against the bias exerted by the spring 50. This operation allows the tablets accommodated in the conveyor vessel 46 to fall into the input hopper 94.

Figure 16A:
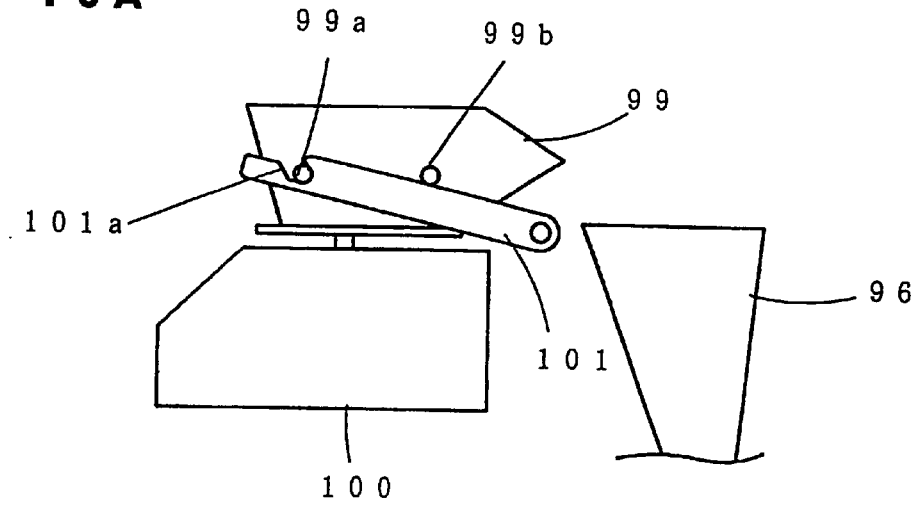
FIGS. 16(*a*), 16(*b*) and 16(*c*) are front views illustrating the operation of the tablet weighing section of the tablet packing section shown in FIG. 11.
Figure 16B:
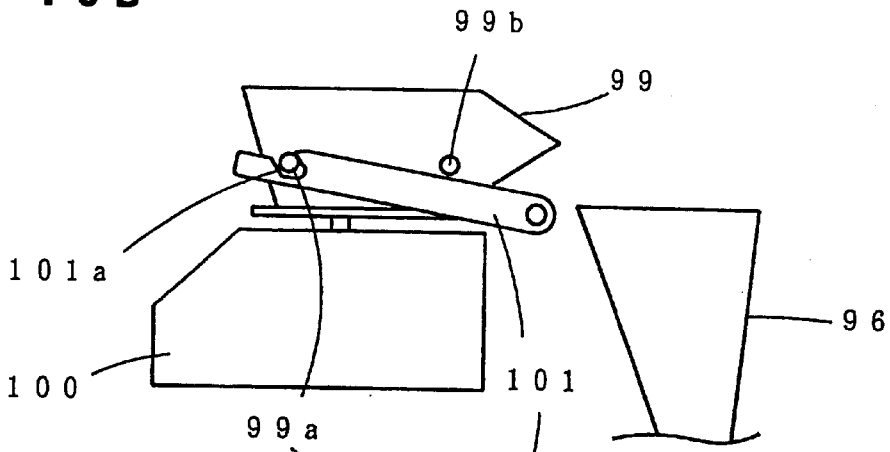
Figure 16C:
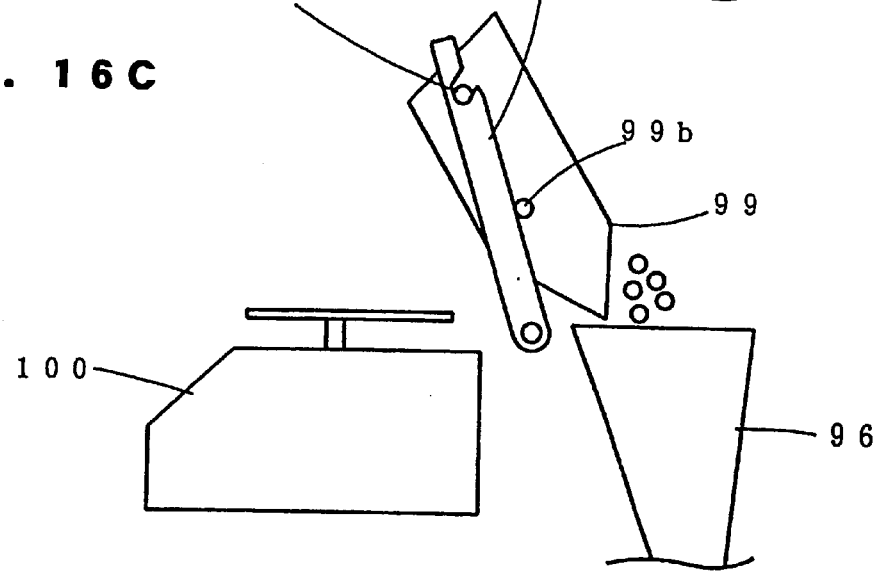

As shown in FIG. 11, the weighing section 95 comprises a weighing vessel 99 for accommodating tablets which have fallen from the input hopper 94, a weighing device 100 for weighing the weighing vessel 99 along with the accommodated tablets, and a pair of arms 101 for supporting the weighing vessel 99. Two projections 99*a*, 99*b*, as shown in FIG. 16(*a*), are formed on each outside surface on both sides of the weighing vessel 99. At the distal end of each arm 101 is formed an engaging recess 101*a* which engages with the projection 99*a* at one end. The engaging recess 101*a* is so shaped that the projections 99*a* on the weighing vessel 99 are prevented from falling out when tablets in the weighing vessel 99 are fed into the packing hopper 97 with the pivotal motion of the arms 101. When tablets are fed from the input hopper 94 into the weighing vessel 99, the arms 101 suspend the weighing vessel 99 above the weighing device 100 so that the impulsive force caused by the feeding cannot act directly on the weighing device 100. After the feeding, the arms 101 pivot to load the weighing vessel 99 on the weighing device 100. With this arrangement, the measuring time by the weighing device 100 is shortened.

The bottom surface of the measuring hopper 96 comprises a shutter 96*a*. Packing amount detecting sensors 102 are provided on the side surfaces facing each other of the measuring hopper 96, so that the amount of the tablets stocked in the measuring hopper 96 can be determined.

Figure 14:
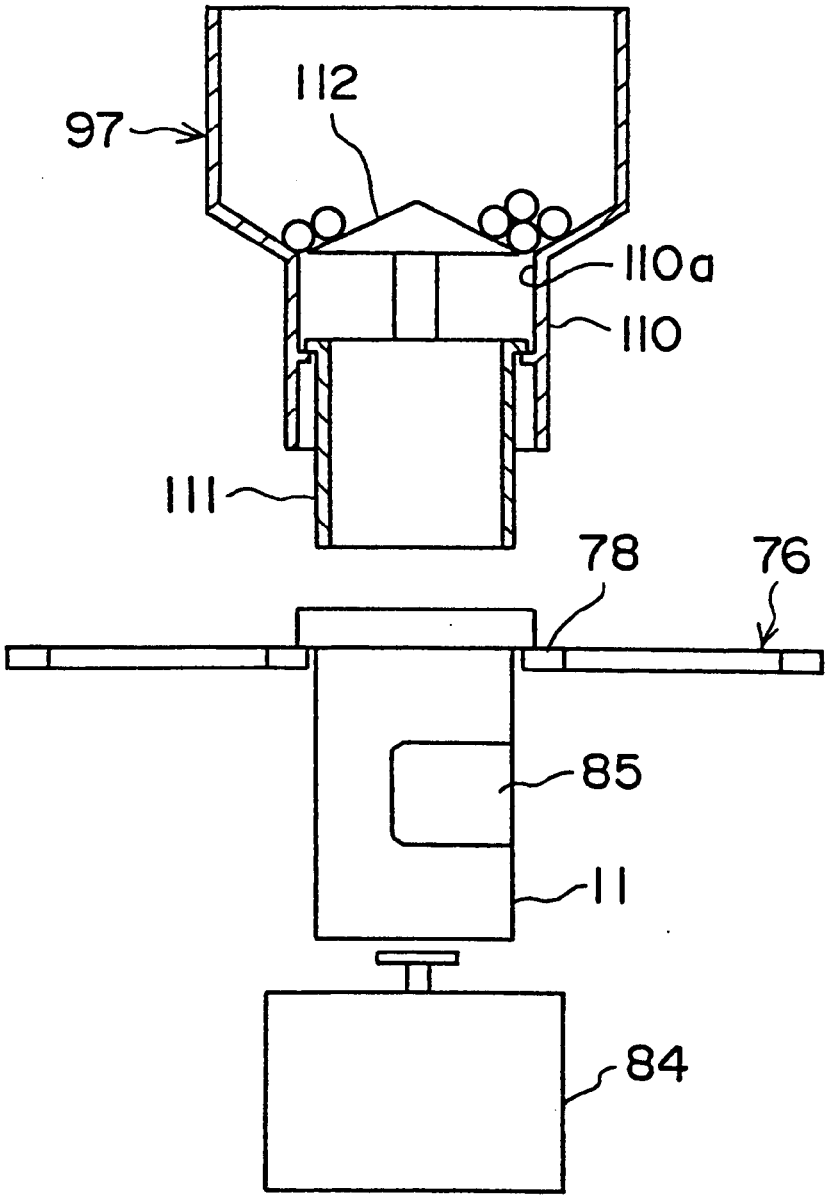
FIG. 14 is a front view illustrating a vessel support portion and a filling hopper of the tablet packing section shown in FIG. 11.

The upper openings of the packing hopper 97 and of the discharging hopper 98 are closed and opened by a closing/opening door 103 provided pivotably. The lower end of the packing hopper 97, as shown in FIG. 14, extends so as to gradually reduce its diameter and connects to a lower cylindrical portion 110 to form a step like shape. In the lower cylindrical portion 110, an internal cylinder 111 is disposed so as to move vertically. A hood 112 is fixed on the upper end of the internal cylinder 111 so that the hood 112 can open and close the internal opening 110*a* of the lower cylindrical portion 110. Thus, when the tablet vessel 11 is raised by the lifter 84 to push up the internal cylinder 111, tablets supported by the hood 112 are discharged into the tablet vessel 11.

Figure 17:
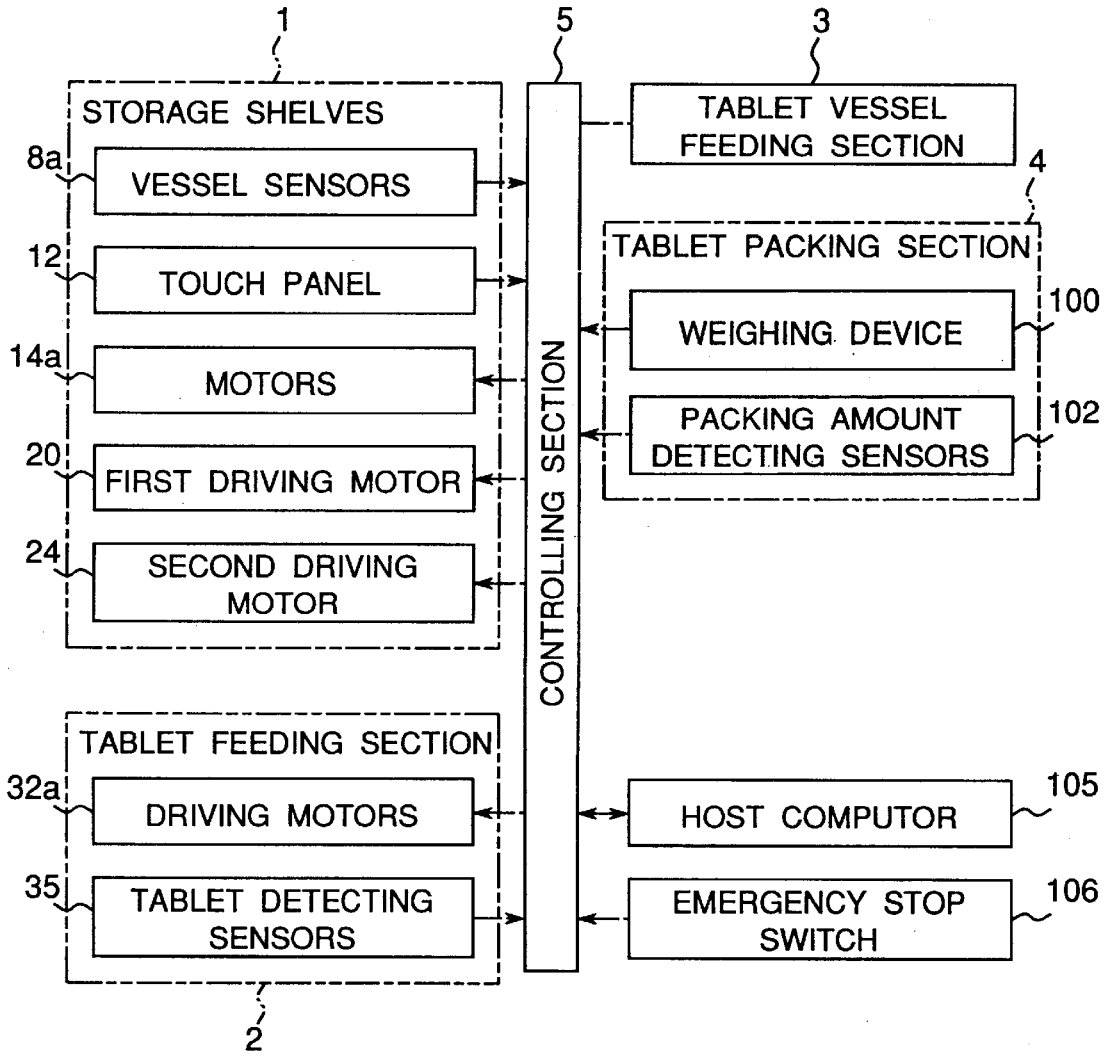
FIG. 17 is a block diagram of the tablet packing apparatus in accordance with the present invention.

As shown in FIG. 17, the controlling section 5 receives an input of prescription data from a host computer 105 (or only an input signal from the touch panel 12). The controlling section 5 also receives a signal from or actuates and controls the storage shelves 1 (e.g., the vessel sensors 8*a,* the touch panel 12, motors 14*a,* the first driving motor 20, and the third driving motor 24), the tablet feeding section 2 (e.g., the driving motors 32*a,* and the tablet detecting sensors 35), the tablet vessel feeding sections 3, and the tablet packing section 4 (e.g., the weighing device 100, the packing amount detecting sensors 102) and an emergency stop switch 106 and so on.

The operation of the tablet packing apparatus as arranged above will be described below.

Figure 18:
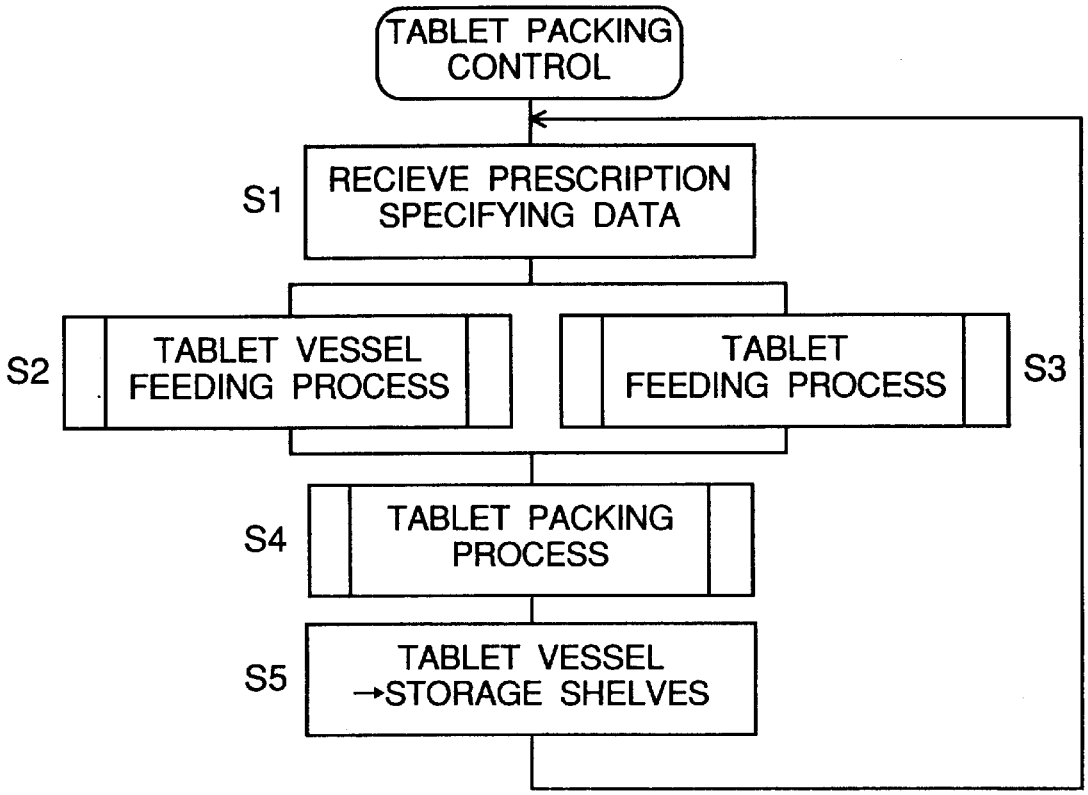
FIG. 18 is a main flow chart illustrating the tablet packing control.

As shown in the flow chart of FIG. 18, first, prescription specifying data based on prescription data is received from the host computer 105 (step S1). A empty tablet vessel feeding process (step S2) and a tablet feeding process (step S3) are then performed simultaneously in parallel on the basis of the prescription specifying data. Subsequently, a tablet packing process (step S4) is performed, and a vessel delivering process (step 5) is then performed for delivering the tablet vessel 11 to the container chamber 6 in the storage shelves 1. The prescription specifying data may be received in multiple according to the processing capacity.

Figure 19:
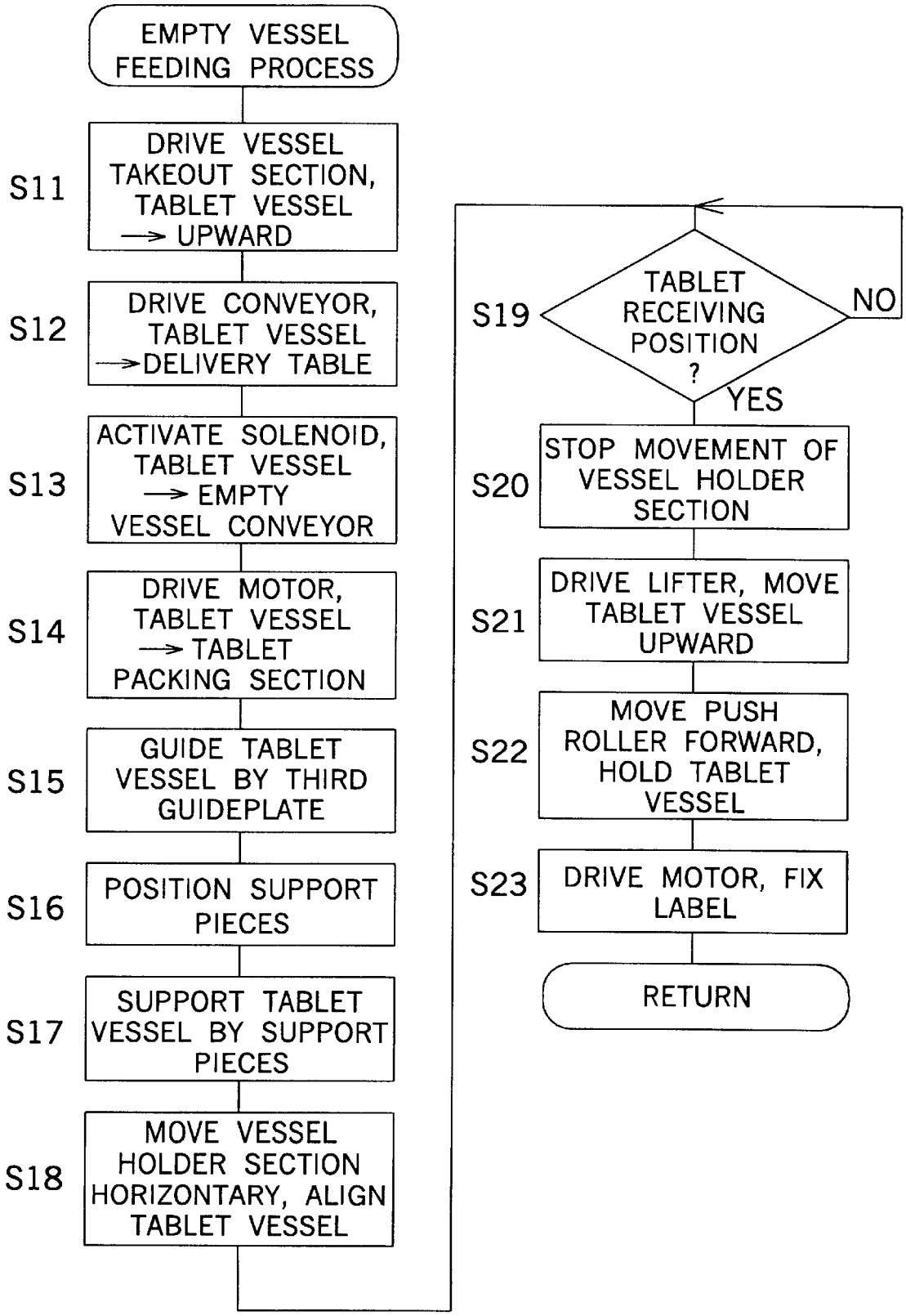
FIG. 19 is a flow chart illustrating an empty vessel feeding process in FIG. 18.

In the empty vessel feeding process, as shown in the flow charts of FIG. 19, in accordance with the above prescription data, the vessel takeout section 52 in the stock container 51 in which the tablet vessels 11 corresponding to the prescription data are contained is operated (step S11). In the vessel takeout section 52, the tablet vessels 11 are conveyed upward in laterally held condition by the lateral vessel holding portions 59. At this time, the vertical vessel eliminating portions 60 prevent the tablet vessels 11 from being held by the lateral vessel holding portions 59 in a vertical condition or in a laterally overlaid condition. Feeding of the next tablet vessel 11 is carried out by operating the vessel takeout section 52 in the stock container 51 when use of the tablet vessel 11 held on the vessel holder section 76 is decided, i.e., when the next prescription data is inputted.

When the tablet vessel 11 is conveyed upward by the vessel takeout section 52, operation of the conveyor 61 is commenced to move the tablet vessel 11 to the delivery table 62 (step S12). Then, activation of the solenoid (not shown) causes the delivery table 62 to pivot, and thereby the tablet vessel 11 is delivered to the empty vessel conveyor 53 (step S13).

In the empty vessel conveyor 53, after the tablet vessel 11 is delivered from the stock container 51, the motor (not shown) is driven to convey the tablet vessel 11 to the tablet packing section 4 by the conveyor ropes 72 (step S14).

In the tablet packing section 4, the tablet vessel 11 is delivered to the second guide plate 80 through the first guide plate 79 and then guided by the third guide plate 81 (step S15). The vessel holder section 76 is horizontally moved to position the pair of support pieces 78 corresponding to the size of the tablet vessel 11 to be conveyed at the lower end edge portion of the second guide plate 80 (step S16). Then, the third guide plate 81 is pivoted so that the tablet vessel 11 is supported by the support pieces 78 of the vessel holder section 76 (step S17). As a result, the flange portion of the tablet vessel 11 is supported, and thereby the tablet vessel 11 is necessarily oriented in an upwardly opened condition.

The support positions of the tablet vessels 11 on the support pieces 78 are different in accordance with the sizes and the delivery directions of the tablet vessels 11. Therefore, the vessel holder section 76 is horizontally moved, and the tablet vessels 11 are aligned by the vessel aligning plate 82 (step S18). If the tablet vessel 11 reaches the tablet receiving position (step S19), then the movement of the vessel holder section 76 is stopped (step S20). Consequently, the lifter 84 is driven to slightly lift the tablet vessel 11 from the vessel holder section 76 (step S21). In this condition, the push rollers 92 are moved forward (step S22), thereby the tablet vessel 11 is held by the push rollers 92 and the guide roller 93. Then, the motor 93*a* is driven to rotate the guide roller 93 so that the label 85, on which predetermined information is printed, is fixed on the outer surface of the tablet vessel 11 (step S23).

Figure 20:
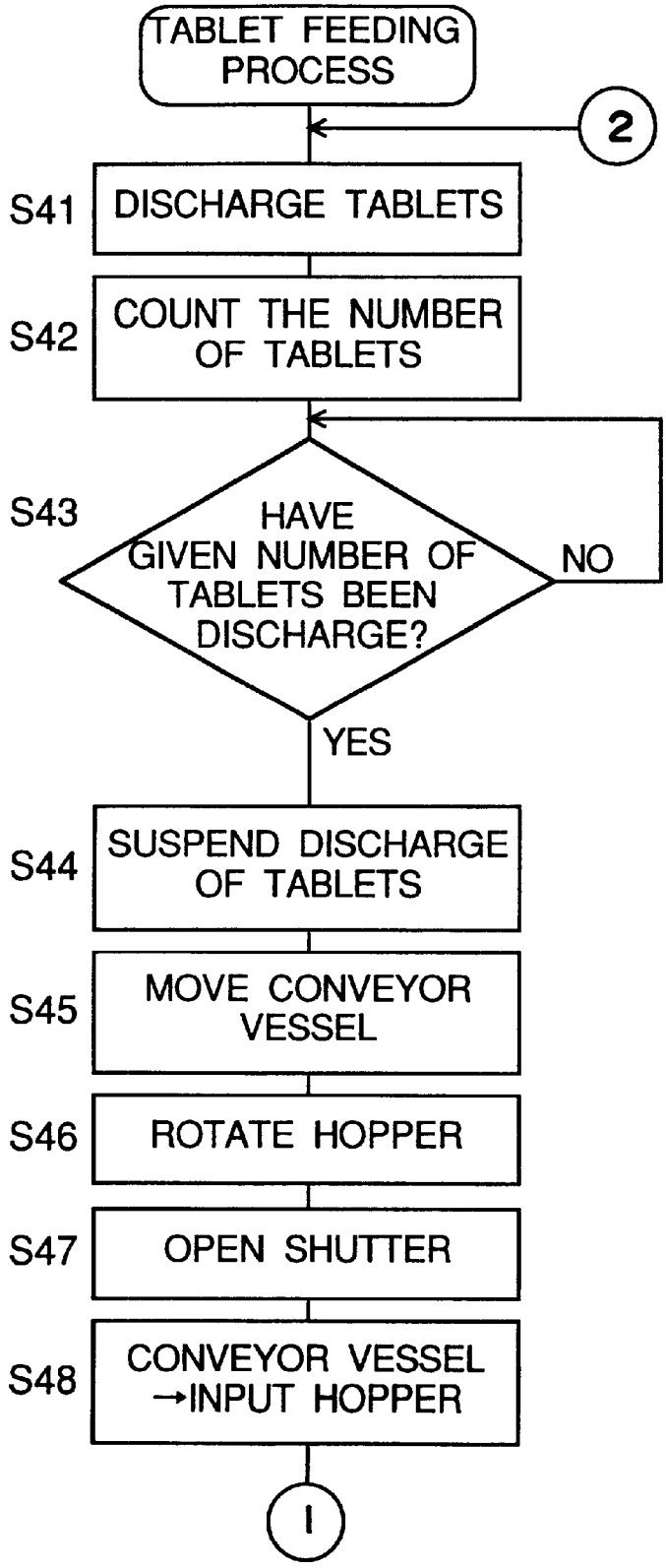
FIG. 20 is a flow chart illustrating a tablet feeding process in FIG. 18.
Figure 21:
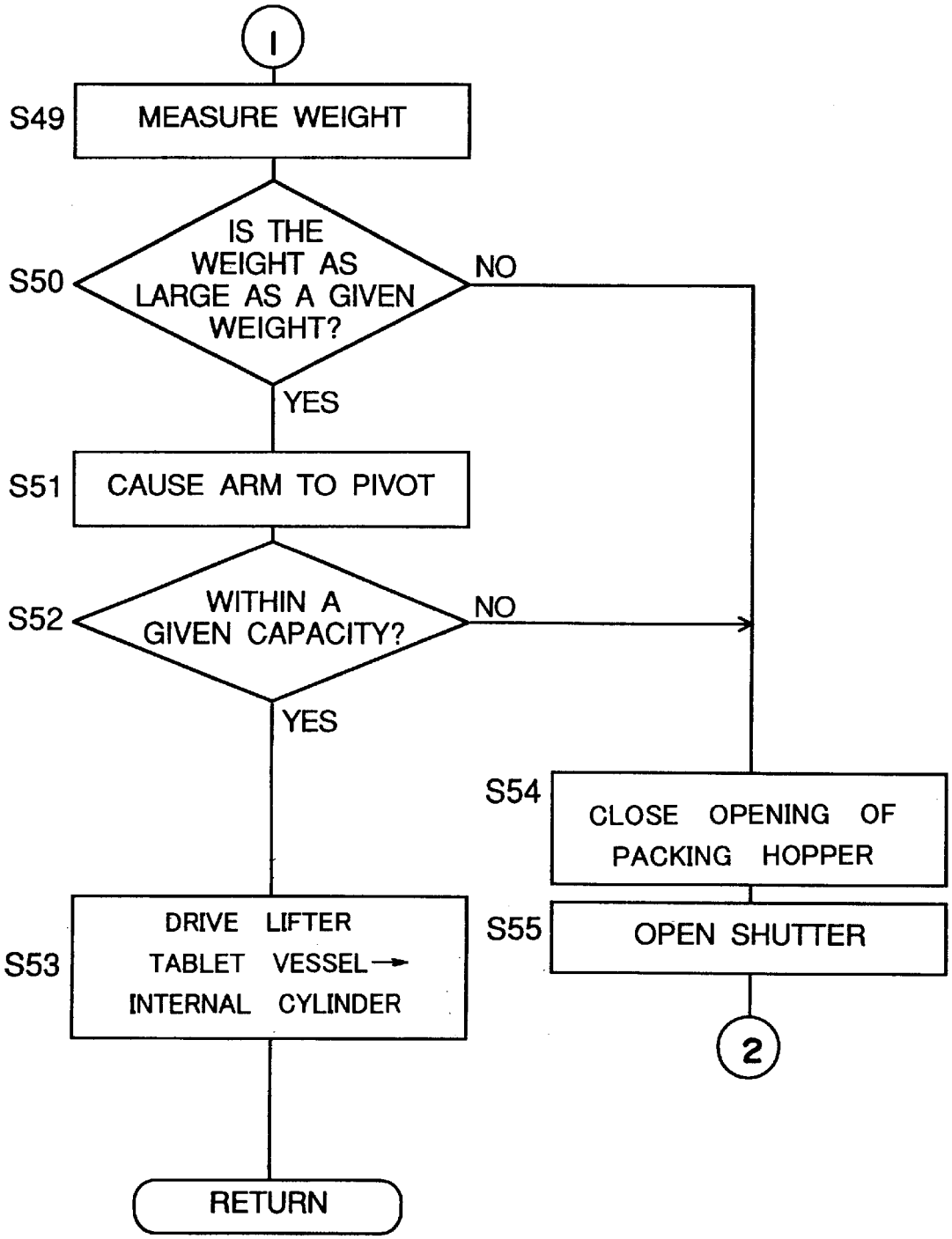
FIG. 21 is a flow chart continued from FIG. 20.
Figure 22:
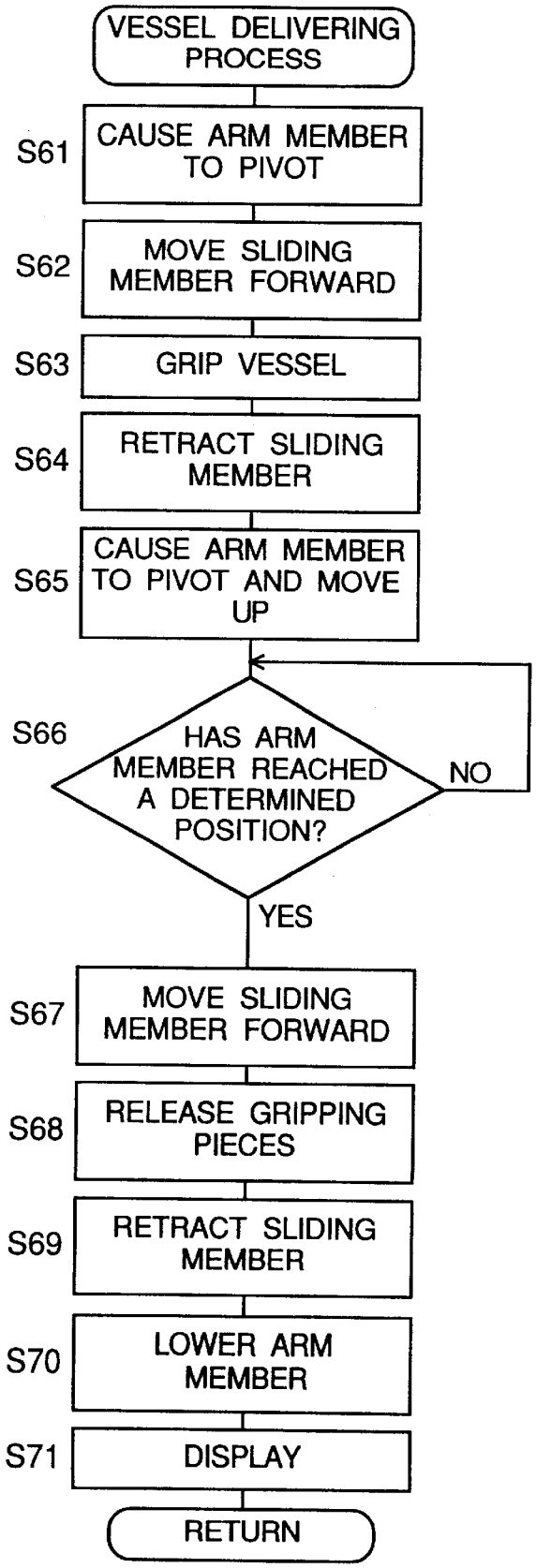
FIG. 22 is a flow chart illustrating a vessel delivering process in FIG. 18.

In the tablet feeding process, as shown in the flow chart of FIGS. 20 and 21, a relevant tablet container section 26 is actuated and controlled on the basis of the prescription specifying data. That is, the built-in motor in the relevant motor base 32 is driven to rotate the rotor 39 to discharge a given number of the tablets stored in the feeder vessel 36 (step S41). The number of the discharged tablets is counted by the tablet detecting sensor 35 provided in the fall guide path 34 (step S42). After the given number of tablets are discharged from the feeder vessel 36 through the fall guide path 34 into a common guide path 31 (step S43), the rotation of the rotor 39 is halted to suspend the discharge of tablets (step S44).

The tablet conveyor section 27 is then actuated and controlled; that is, the pulleys 47 are driven and rotated so that the conveyor vessel 46 is moved by the conveyor belt 48 and positioned under the common guide path 31 (step S45). The hopper 44 is then rotated to direct the opening thereof to the conveyor vessel 46 (step S46), and the shutter 49 is opened to allow the tablets to be stored in the conveyor vessel 46 (step S47).

After the given number of the relevant tablets are stored in the conveyor vessel 46, the conveyor vessel 46 is moved to the input hopper 94 by the actuation and control of the tablet conveyor section 27 (step S48). At this time, the protrusion 49*a* of the shutter 49 comes into contact with an edge of the input hopper 94, and the movement of the conveyor vessel 46 causes the shutter 49 to open gradually, so that the stored tablets are input into the weighing vessel 99 through the input hopper 94. The weighing vessel 99 is then suspended slightly above the weighing device 100 by the pivotal motion of the arms 101, so that the impulsive force caused by the input of the tablets cannot act directly on the weighing device 100. Subsequently, the weighing vessel 99 is loaded on the weighing device 100 by the pivotal motion of the arms 101 and the weight of the weighing vessel 99 is measured (step S49)

It is then judged whether the weight is as large as a given weight or not (step S50). The tablets are then fed into the measuring hopper 96 by the pivotal motion of the arms 101 (step S51). Whether the amount of the tablets is within the capacity of the tablet vessel 11 or not is then judged on the basis of detection signals from the packing amount detecting sensors 102 in the measuring hopper 96 (step S52).

In the case that the weight is as large as the given value and that the amount of the fed tablets is not more than the given amount, it is judged that the relevant tablets could be packed by the given amount. Then, the tablet vessel 11 is further lifted by the lifter 84 so that the internal cylinder 111 of the packing hopper 97 is raised (step S53). As a result, the internal opening 110*a* is opened by the hood 112, and thereby the tablets are packed in the tablet vessel.

In the case that the weight is larger or smaller than the given value or that the amount of the fed tablets is larger than the given amount, it is judged that the tablets are irrelevant or that the amount of the tablets exceeds the capacity of the tablet vessel 11. The opening of the packing hopper 97 is then closed (step S54), and the shutter 96*a* is opened (step S55). The tablets are thus discharged through the discharging hopper 98. In this case, returning to step S41, the tablet feeding process is performed a new.

After the tablets are packed into the tablet vessel 11, the process for delivering the vessel to the storage shelves 1 is performed. At this time, a using condition of the container chamber 6 is confirmed by referring to a storage shelves data table and vacant container chambers 6 are specified. The storage shelves data table is established based on a detected signal of the vessel sensor 8*a* provided in each container chamber 6 of the storage shelves 1. Among the vacant container chambers 6, the order of the container chambers 6 in which the tablet vessel 11 is to be delivered is decided. In the present embodiment, the order of positions of the container chambers 6 from which an operator can easily take out the tablet vessel 11 is decided.

After the container chamber 6 to which the tablet vessel 11 is to be delivered is decided, the arm member 15 is caused to pivot (step S61), the sliding member 22 is moved forward relative to the arm body 19 (step S62), and the tablet vessel 11 is gripped by the gripping pieces 25 (step S63). The sliding member 22 is then retracted (step S64), and the arm member 15 is caused to pivot and elevated (step S65). The position where the arm member 15 is to reach with the pivotal motion and elevation is such a position as determined as described above, i.e., the container chamber 6 from which the operator can easily take out the tablet vessel 11.

Once the arm member 15 reaches the determined position to reach with the pivotal motion and elevation (step S66), a using condition of the container chamber 6 is confirmed again based on the detected signal of the vessel sensor 8*a* provided in the corresponding container chamber 6. If the tablet vessel 11 is not contained, the sliding member 22 is moved forward to open the door 6*a* and deliver the gripped tablet vessel 11 to the container chamber 6 in the storage shelves 1 (step S67) The tablet vessel 11 then travels to the recesses 10*a* while pushing aside the holding plates 9 in the container chamber 6 through the medium of the cutouts 10*b* formed in the holding lugs 10, and is held with the bias exerted by the spring 9*a*. The gripping pieces 25 are then released (step S68); the sliding member 22 is retracted (step S69); and the arm member 15 is subsequently lowered (step S70) for the delivery of the next tablet vessel 11. Just before the tablet vessel 11 is contained in the container chamber 6, if a tablet vessel 11 is detected in the container chamber 6, another container chamber 6 in which the tablet vessel 11 can be contained is retrieved and then the tablet vessel 11 is contained in the retrieved container chamber 6.

In the selection of the aimed container chamber 6, the container chambers 6 may be numbered so that the number increases with increase in the period of time required for the delivery of a tablet vessel 11 to the container chamber 6 by the arm member 15, and the vacant container chamber 6 which has the smallest number may be selected as the aimed chamber.

Once the tablet vessel 11 packed with the given amount of the specified tablets is thus delivered to the container chamber 6 in the storage shelves 1, the numbers assigned to the feeder vessels and the counts of the tablets are displayed on the display 7 of the relevant container chamber 6 in response to a detection signal from the vessel sensor 8*a* (step S71).

In the aforementioned tablet packing apparatus, when an emergency stop button which is provided in both the lower middle portion of the storage shelves 1 and the middle potion of the tablet vessel feeding sections 3 is pressed down, or power supply is cut off due to power failure or the like during the operation, the apparatus is shut down. In this case, the power supply to the motor base 32 which operates the tablet container section 26 is stopped, preventing misfeeding of the tablets. Whereas, the power supply to the controlling section 5 is not stopped and it is communicated to the controlling section 3 that it is an emergency stop condition. At the normal stop of the power supply, without simultaneously stopping the power supply to both the motor base 32 and the controlling section 5, the power supply to the motor base 32 is stopped first and then the power supply to the controlling section 5 is stopped. The controlling section 5 is possible to receive a supply of power from a secondary power source (not shown), and the operating condition is maintained. However, there may arise a case in which the information on the tablet vessel 11 and the tablet, which had been under conveyance, can not be perfectly controlled. Thus, it is required to execute a restoring process in which the tablet vessel 11 and the tablet, which had been under conveyance, is recovered to reset the information.

In the restoring process which will be explained in detail hereinafter, the tablet vessel 11 and the tablet which had been under conveyance is recovered into the container chambers 6 of the storage shelves 1. Therefore, in the case that there is no room or insufficient room for the container chambers 6, the tablet vessels 11 should be removed from the container chambers 6 so that the restoring process can be executed. Moreover, in the conveyance path of the tablet vessels 11 (the empty vessel conveyor 53, the vessel holder section 76 and so on), the empty vessel conveyor 53 is reversed for a predetermined time to remove the tablet vessel 11 on the empty vessel conveyor 53. In the vessel holder section 76, the size data of the tablet vessel 11 is memorized again by means of the size detecting sensor for detecting the size of the tablet vessel 11 provided between the push rollers 92.

It is preferable to make an indication on the touch panel 12 that the tablet is removed. Since an error that either the feeder vessels 36 or the stock vessel 51 is empty does not shows abnormality, the restoring process is not executed in such case.

Figure 23:
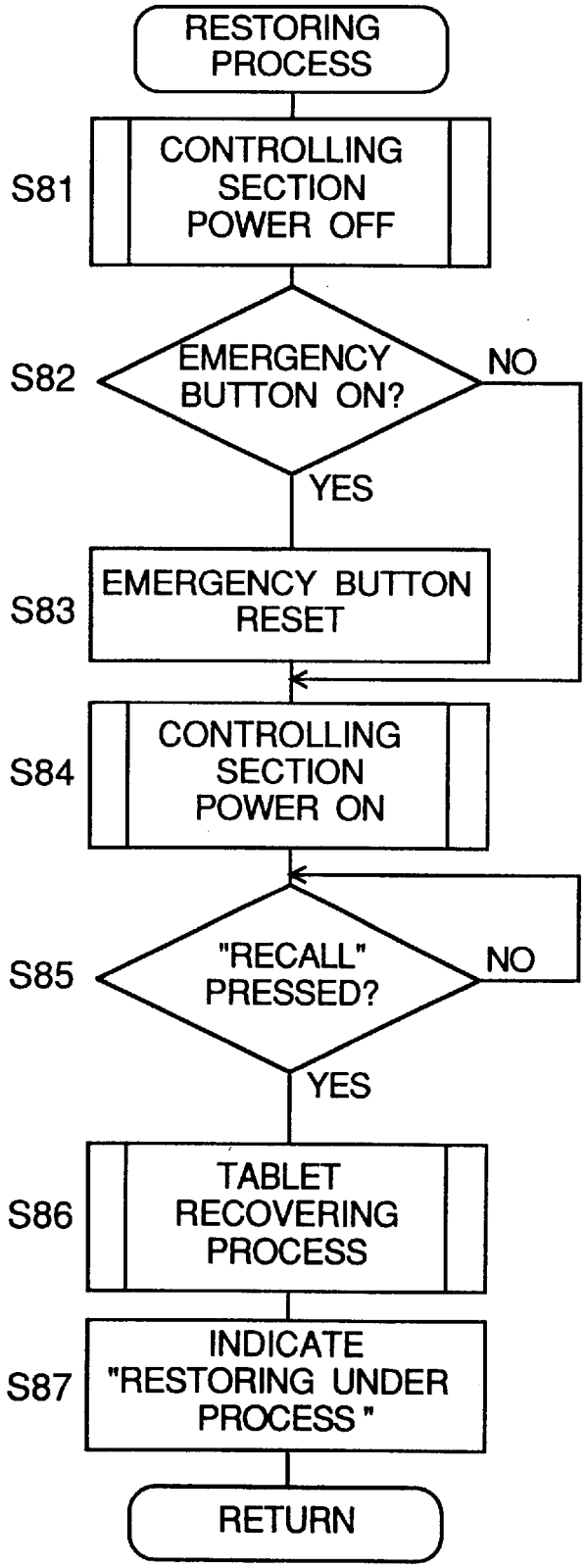
FIG. 23 is a flow chart illustrating a recovery process.

The restoring process will be explained in accordance with the flow chart as shown in FIG. 23.

Figure 25A:
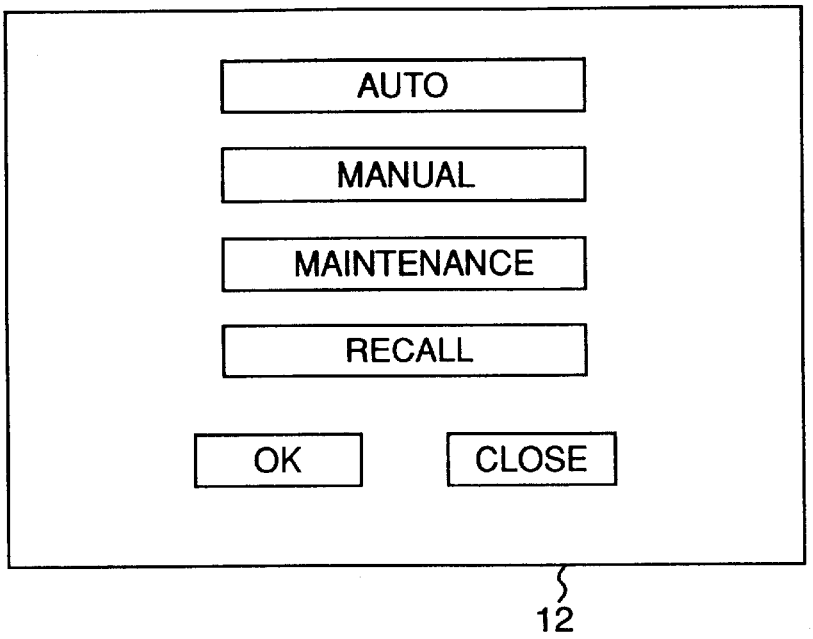
FIGS. 25(*a*) and 25(*b*) are views illustrating a main menu displayed on a touch panel.
Figure 25B:
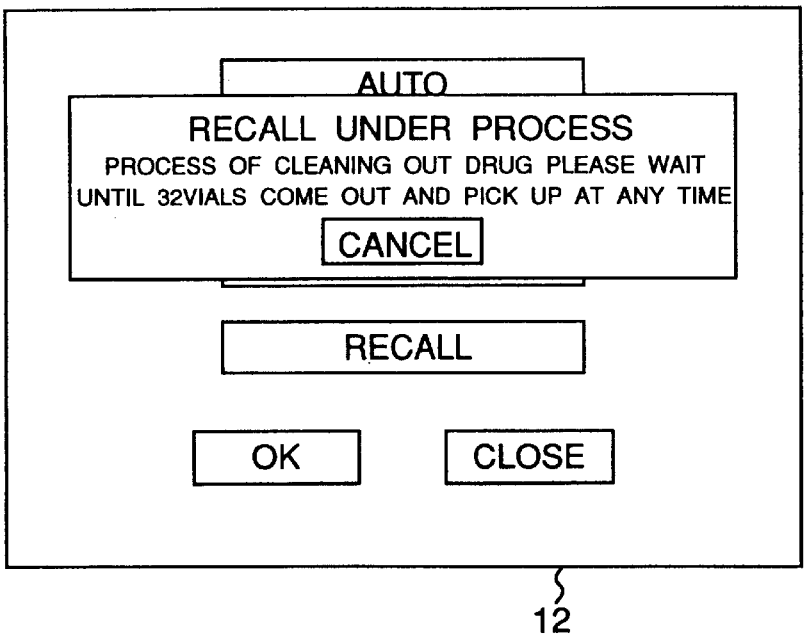
Figure 26A:
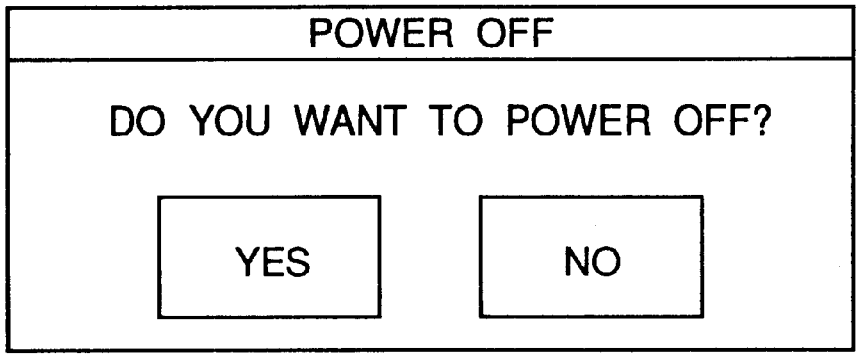
FIGS. 26(*a*) and 26(*b*) are front views illustrating contents displayed on the touch panel in the case of power-off.
Figure 26B:
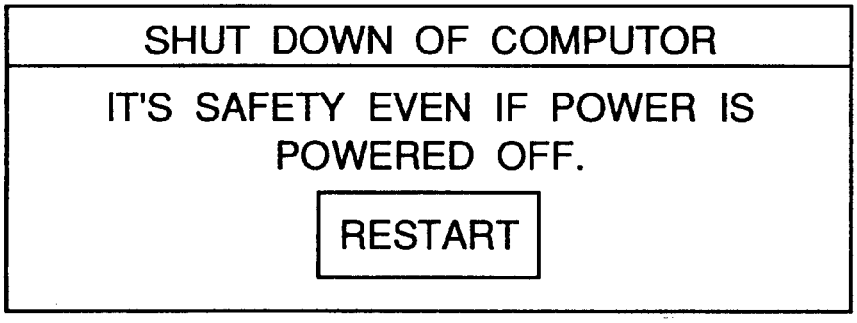
Figure 27:
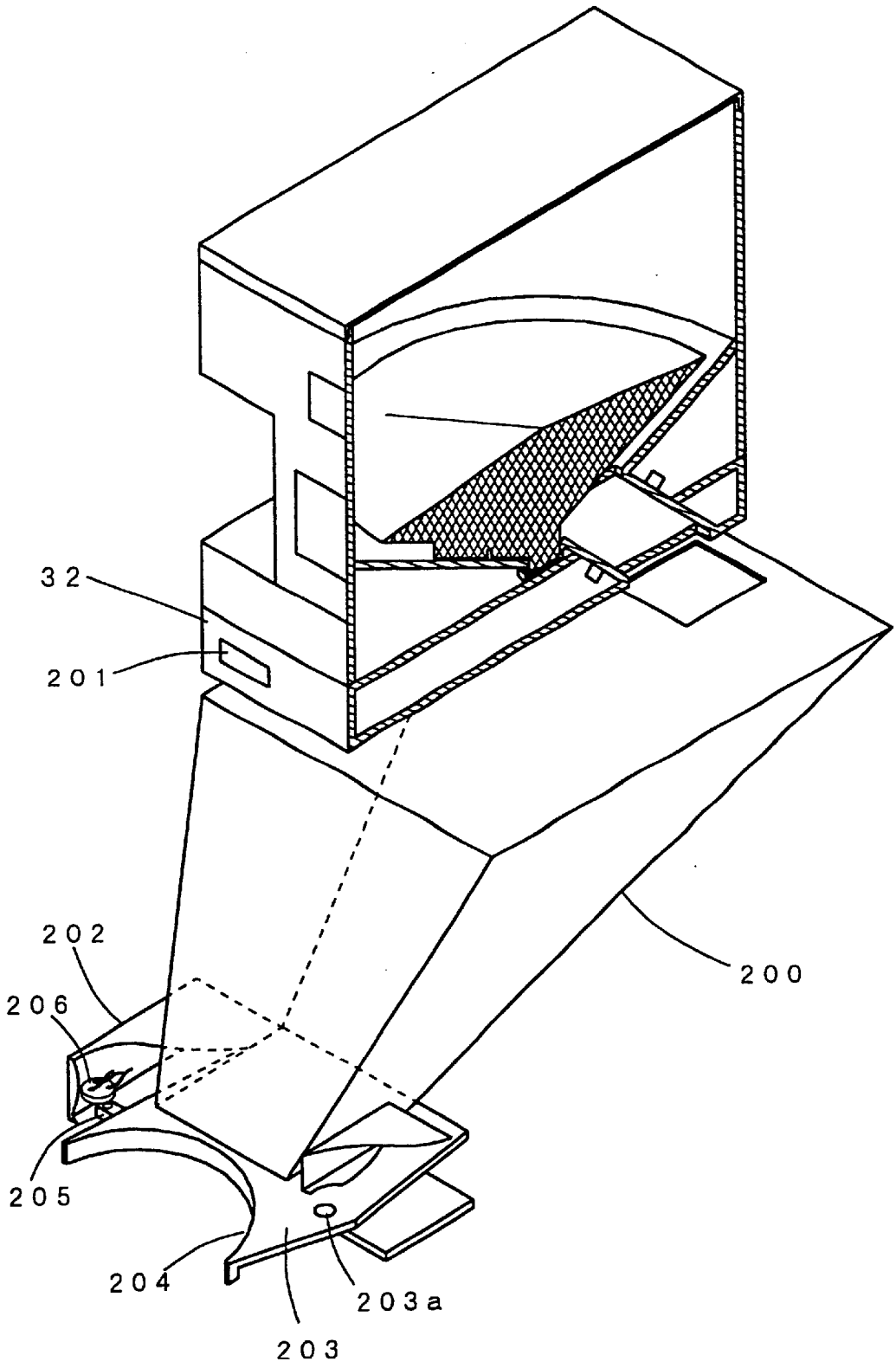
FIG. 27 is a perspective view illustrating a tablet feed section provided with a particular dispensing apparatus.

The controlling section 5 is once powered off (step S81). This is because of the deletion of the processing data temporally stored in the memory of the controlling section 5. When an area displayed on the touch panel 12 by "CLOSE" as shown in FIG. 25(*a*) is touched, the indications of "DO YOU WANT TO POWER OFF?", "YES" and "NO" are displayed as shown in FIG. 26(*a*). If the "YES" is selected, the indication that "IT'S SAFETY EVEN IF POWER IS POWERED OF" is displayed as shown in FIG. 26(*b*) to power off.

If the emergency stop button is pressed down (step S82), then the emergency stop button is reset (step S83) and the controlling section 5 is powered on again (step S84). Thus, the menu is displayed on the touch panel 12 as shown in FIG. 25(*a*).

Among the items as shown in FIG. 25(*a*), if the "RECALL" is touched (step S85), then the recovering process of the tablet which had been under conveyance is commenced (step S86). At this time, the indication that "RECALL UNDER PROCESS . . . " is displayed on the touch panel 12 as shown in FIG. 25(*b*) to indicate that restoring process is going on (step S87).

Figure 24:
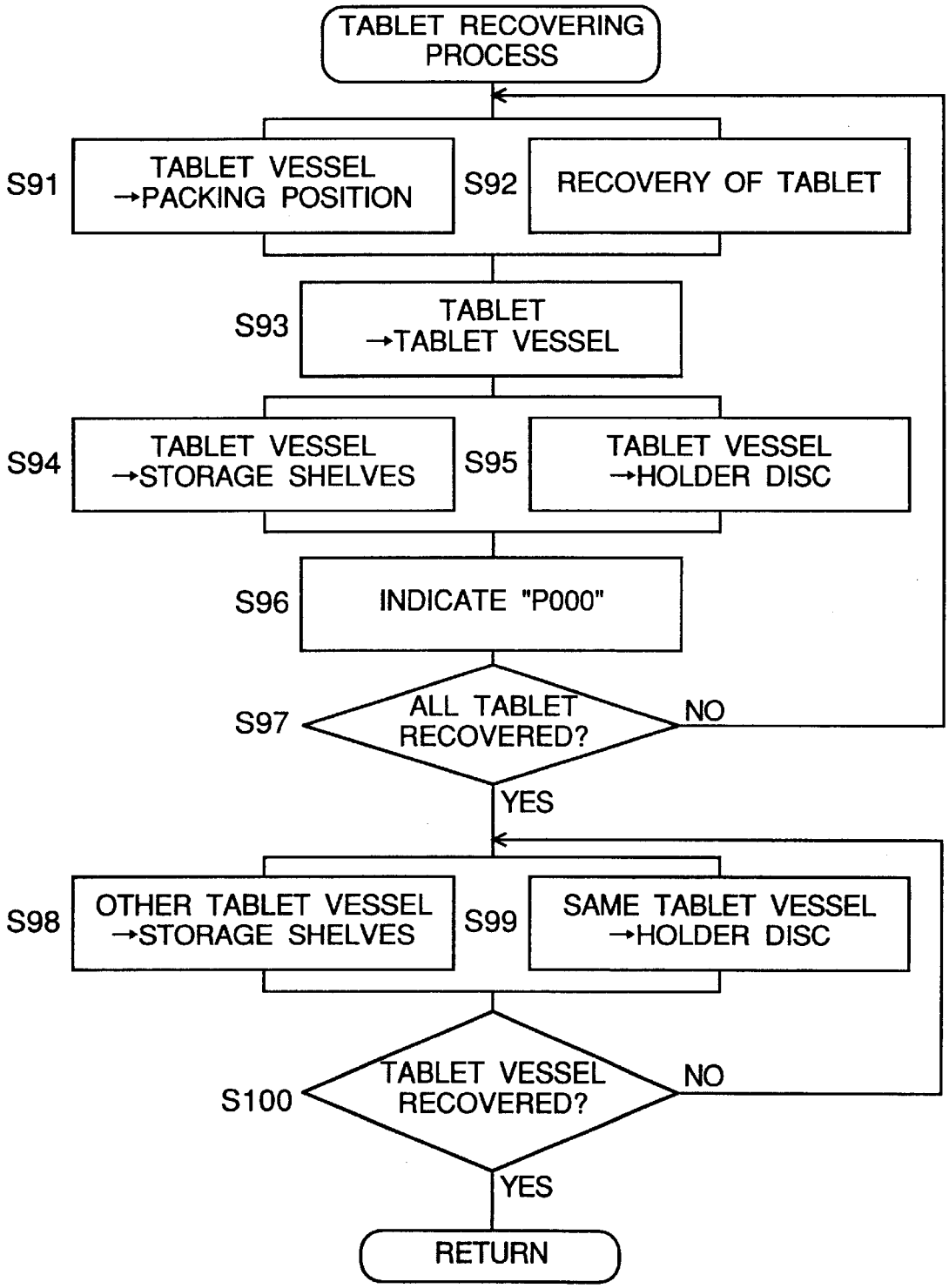
FIG. 24 is a flow chart illustrating the tablet recovering process in FIG. 23.

In the tablet recovering process, the tablets remaining in the conveyor vessels 46 and the hoppers 44 are recovered as shown in flow chart of FIG. 24. At first, the vessel holder section 76 is moved to position the tablet vessel 11 having the largest capacity at the packing position, i.e., beneath the packing hopper 97 (step S91). Normally, since the tablet vessel 11 having the largest capacity is ready on the vessel holder section 76, such tablet vessel 11 is used. If such tablet vessel is not ready, it is replenished from the stock vessel 51. On the other hand, the tablets are recovered from any one of the common guide paths by means of the conveyor vessel 46 (step S92). Then, the tablets are packed into the largest tablet vessel 11 through the input hopper 94 and the packing hopper and so on (step S93). Consequently, the tablet vessel 11 packed with the tablets is transferred to the container chamber 6 of the storage shelves 1 by the arm member 15. At the same time, a tablet vessel 11 having the same size as the tablet vessel transferred to the storage shelves 1 is replenished to the vessel holder section 76 (step S95). In addition, the indication of "P000" is displayed on the display 7 (step S96) to enable an operator to distinguish at a glance that the recovered tablets are packed in the tablet vessel 11 transferred to the container chamber 6.

In the same manner as explained above, a tablet vessel 11 having the largest capacity is replenished to the vessel holder section 76 from the stock vessel 51 to recover the tablets remaining in the another common guide paths 31. Although there may be no tablet in the common guide paths 31, the recovery process of tablets should be executed from all of the common guide paths 31 in order to perfectly grasp which tablets had been under conveyance.

If the tablets remaining in all common paths 31 (step S97) is recovered, then other size of the tablet vessels 11 held on the vessel holder section 76 are recovered to the storage shelves 1 (step S98). In this case, the tablet vessels 11 having the same size as that of the tablet vessels 11 which are recovered and transferred to the container chamber 6 of the storage shelves 1 are replenished to the vessel holder section 76 from the corresponding stock vessel 51 (step S99).

If the recovery of the tablet vessels is finished (step S100), then main menu is displayed on the touch panel 12. The touch with "AUTO" enables the restoration to the normal operation, i.e., the tablet vessel feeding process (step S2), the tablet feeding process (step S3) and the tablet packing process (step S4) in the same manner as described before.

In the above explained restoring process, in the case that the tablet packing apparatus is stopped due to the abnormality, the controlling section 5 is always powered off to clear the processing data stored in the memory. However, it may be also possible to have the operator select whether such processing data is utilized or not. For example, when the indication of "RECALL" displayed on the touch panel 12, the processing data which are stored before the apparatus is stopped may be utilized to continue the process. In this case, the tablet vessels 11 remaining in the empty vessel conveyor 53, the vessel holder section 76 and so on, or the tablets remaining in the common guide paths 31 and the like are not necessary to be recovered.

Moreover, in the above explained restoring process, the indication of "P000" indicating recovery. is displayed on the display 7 of the container chamber 6. Instead of this, it is also possible to indicate which feeder vessel 36 the tablets were discharged from. In this case, it is necessary to memorize the common guide path from which the tablets were recovered based on the position of the conveyor vessel 46. Thus, according to both the memorized common guide path and the processing data, it is possible to specify the feeder vessel 36 from which the tablets were discharged.

The tablets to be contained in the tablet feeding section 2 include special tablets (for example, pyrine medicines and histamine tablets which cause allergy). Therefore, if a packing operation is carried out through a common passage, there would be risks that the special tablets are mixed into the other tablets due to the troubles and so on of the apparatus. Therefore, it is preferable to provide a particular dispensing apparatus in the tablet feeding section 2 containing the special tablets.

The particular dispensing apparatus comprises a tablet reserving member 200 for temporarily reserving the tablets fed from the motor base 32. An LED 201 is provided on the front surface of the motor base 32. The LED 201 is ON when the tablets are reserved in the tablet reserving member 200 from the motor base 32. The lower opening of the tablet reserving member 200 can be closed by a shutter 203 which is rotatably supported around a support shaft 203*a* on a support member 202. The shutter 203 is formed with an arc-like cutout 204 on its front edge and also provided with a detection piece 205 on its side edge. The cutout 204 is arranged to engage the flange of the tablet vessel with the internal edge of the cutout 204 in order to position the tablet vessel 11 so as to push the shutter 203. The detection piece 205 is detected by a sensor 206 provided on the support member 202 when the lower opening of the tablet reserving member 200 is closed by the shutter 203. The shutter 203 is urged by urging means such as spring or so not shown so that the lower opening of the tablet reserving member 200 can be closed.

In the tablet feeding section 2 with the particular dispensing apparatus having above construction, when the motor base 32 is driven and the special tablets are reserved in the tablet reserving member 200, the LED 201 is ON. Thus, an operator can recognize at a glance from which tablet feeding section 2 are discharged the special tablets to be packaged. Then, the operator set the tablet vessel 11 on the particular dispensing apparatus of the tablet feeding section 2 in which the LED 201 is ON. Consequently, with the tablet vessel 11 engaged with the cutout 204, the operator push the shutter 203. As a result, the shutter 203 is pivoted around the support shaft 203*a* against the urged force. of the urging means. Thus, the upper opening of the tablet vessel 11 can communicate with the lower opening of the tablet reserving member 200, whereby the special tablets in the tablet reserving member 200 are packed in the tablet vessel 11. At this time, as the sensor 206 does not detect the detection piece 205 of the shutter 203, the LED 201 is OFF.

What is claimed is:

1. A tablet packing apparatus in which tablets fed from a tablet feed section are packed in a tablet vessel fed from a tablet vessel feed section, the apparatus comprising:

a vessel holder member having a plurality of generally parallel support portions which each of which has a length that is longer than a diameter of the tablet vessel; and a guide plate inclined toward the vessel holder member so that the tablet vessel, fed from the tablet vessel feed section, can roll on the guide plate, wherein the vessel holder member is capable of linearly reciprocating between a vessel supporting position where the vessel tablet holder member receives and supports the tablet vessel fed from the guide plate, and a tablet receiving position where the tablets, fed from the tablet feed section, are received in the tablet vessel, wherein a flange of the tablet vessel fed from the guide plate is supported by the support portion.

2. The tablet packing apparatus as claimed in claim 1, further comprising a label fitting portion for fitting a label on an outer surface of the tablet vessel fed from the tablet vessel feed section as the tablet vessel is guided and rotated.

3. The tablet packing apparatus as claimed in claim 1, wherein the support portions are formed so that the distances between adjacent ones of the support portions are different in order to accommodate different sizes of the tablet vessels.

4. The tablet packing apparatus as claimed in claim 1, further comprising a lifting member for lifting the tablet vessel supported on the support portions, and a tablet packing member for temporarily accumulating the tablets fed from the tablet feed section and packing the tablets in the tablet vessel lifted by the lifting member.

5. The tablet packing apparatus as claimed in claim 2, wherein the support portions are formed so that the distances between adjacent ones of the support portions are different in order to accommodate different sizes of the tablet vessels.

6. The tablet packing apparatus as claimed in claim 2, further comprising a lifting member for lifting the tablet vessel supported on the support portions, and a tablet packing member for temporarily accumulating the tablets fed from the tablet feed section and packing the tablets in the tablet vessel lifted by the lifting member.

7. The tablet packing apparatus as claimed in claim 3, further comprising a lifting member for lifting the tablet vessel supported on the support portions, and a tablet packing member for temporarily accumulating the tablets fed from the tablet feed section and packing the tablets in the tablet vessel lifted by the lifting member.

8. A tablet packing apparatus comprising:

a tablet packing section;

a tablet feed section for feeding tablets to the tablet packing section; and a tablet vessel feed section for feeding tablet vessels to the tablet packing section, the tablet vessel feed section comprising:

a vessel holder member having a plurality of generally parallel support portions for holding a vessel fed from the tablet vessel feed section by supporting a flange of the vessel, wherein each of said support portions is designed to have a length that is significantly greater than the diameter of the vessels to be supported;

a vessel guide assembly for receiving the vessels from the tablet vessel feed section and guiding the vessels to the vessel holder member, wherein the vessel holder member is capable of moving linearly between a vessel receiving position where the vessel holder member receives the vessels fed from the tablet vessel feed section via the vessel guide assembly, and a tablet receiving position where the tablets, fed from the tablet feed section, are delivered to the vessel held by the vessel holder member.

9. The tablet packing apparatus as claimed in claim 8, wherein the support portions are spaced so that the distances between adjacent ones of the support portions are different in order to accommodate different sizes of the vessels.

10. The tablet packing apparatus as claimed in claim 8, wherein the vessel guide assembly comprises a vessel aligning plate disposed below the vessel holder portion, wherein the vessel aligning plate is operable to adjust the position of the vessel in a horizontal direction.

11. The tablet packing apparatus as claimed in claim 8, wherein the vessel guide assembly comprises:

a first guide plate, having a substantially V-shape, for receiving the vessel from the tablet vessel feed section;

a second guide plate, which is inclined toward vessel holder member, so that the vessel from the first guide plate can roll toward the vessel holder member; and a third guide plate, which is pivotal relative to the second guide plate, for allowing or preventing the vessel on the second guide plate to pass to the vessel holder member.

12. The tablet packing apparatus as claimed in claim 11, wherein the vessel guide assembly comprises a vessel aligning plate disposed below the vessel holder portion, wherein the vessel aligning plate is operable to adjust the position of the vessel in a horizontal direction.

13. The tablet packing apparatus as claimed in claim 12, further comprising a lifting member for lifting the tablet vessel supported on the support portions at the tablet receiving position.

14. The tablet packing apparatus as claimed in claim 13, further comprising a tablet packing member for temporarily accumulating the tablets fed from the tablet feed section and packing the tablets in the vessel lifted by the lifting member.

* * * * *

UNITED STATES PATENT AND TRADEMARK OFFICE

CERTIFICATE OF CORRECTION

PATENT NO. : 6,581,355 B1
DATED : June 14, 2003
INVENTOR(S) : Shoji Yuyama et al.

It is certified that error appears in the above-identified patent and that said Letters Patent is hereby corrected as shown below:

Title page,
Item [75], Inventors, please change "Yoyonaka" to -- Toyonaka --.

Column 2,
Line 20, please change "invention;." to -- invention; --

Column 10,
Line 67, please change "(step S49)" to -- (step S49). --.

Column 11,
Line 24, please change "a new" to -- anew --.
Line 58, please change "(step S67)" to -- (step S67). --.

Column 14,
Line 13, please change "recovery. is" to -- recovery is --.
Line 62, please change "force. of" to -- force of --.

Signed and Sealed this

Sixth Day of January, 2004

JAMES E. ROGAN
*Director of the United States Patent and Trademark Office*